US008844441B2

(12) United States Patent
Rossini

(10) Patent No.: US 8,844,441 B2
(45) Date of Patent: Sep. 30, 2014

(54) HIGH-RIGIDITY ADAPTER SLEEVE FOR PRINTING CYLINDERS

(75) Inventor: Felice Rossini, Milan (IT)

(73) Assignee: Rossini S.p.A., Milan (IT)

( * ) Notice: Subject to any disclaimer, the term of this patent is extended or adjusted under 35 U.S.C. 154(b) by 720 days.

(21) Appl. No.: 12/638,554

(22) Filed: Dec. 15, 2009

(65) Prior Publication Data

US 2010/0147171 A1 Jun. 17, 2010

(30) Foreign Application Priority Data

Dec. 16, 2008 (IT) ..... MI2008A2225

(51) Int. Cl.
*B41F 13/08* (2006.01)
*B41F 27/10* (2006.01)
*B41F 27/14* (2006.01)

(52) U.S. Cl.
CPC ..... *B41F 27/105* (2013.01); *B41F 27/14* (2013.01)
USPC ..... 101/378; 101/382.1

(58) Field of Classification Search
USPC ..... 101/382.1, 374–389
See application file for complete search history.

(56) References Cited

U.S. PATENT DOCUMENTS 5,361,697 A * 11/1994 Stellberger ..... 101/415.1
5,515,781 A * 5/1996 Songer ..... 101/401.1
5,711,222 A 1/1998 Taylor et al.
5,819,657 A 10/1998 Rossini
5,904,095 A 5/1999 Nelson
5,974,973 A * 11/1999 Tittgemeyer ..... 101/375
6,209,455 B1 * 4/2001 Simeth ..... 101/382.1
6,276,271 B1 8/2001 Busshoff
6,360,662 B1 3/2002 Busshoff
6,401,613 B1 6/2002 Gayle et al.
6,782,821 B2 8/2004 Dilling et al.
6,796,234 B1 * 9/2004 Busshoff ..... 101/389.1
7,011,021 B2 * 3/2006 Dzierzynski et al. ..... 101/217
7,124,685 B2 10/2006 Re et al.
7,290,488 B2 11/2007 Peterson et al.
7,334,336 B2 * 2/2008 Tan et al. ..... 29/895.3
2002/0020317 A1 * 2/2002 Huber ..... 101/376
2002/0046668 A1 * 4/2002 Bell et al. ..... 101/376
2002/0056387 A1 5/2002 Kolbe et al.
2003/0047097 A1 * 3/2003 Dzierzynski et al. ..... 101/368

(Continued)

FOREIGN PATENT DOCUMENTS

DE 102005039782 3/2007
EP 866259 A2 * 9/1998 ..... F16L 59/06

OTHER PUBLICATIONS

European Search Report, issued Jan. 12, 2012.
EP09179243—European Search Report, dated Jan. 27, 2010.

*Primary Examiner* — David Banh
(74) *Attorney, Agent, or Firm* — Dority & Manning, P.A.

(57) ABSTRACT

An adapter sleeve has an external layer for supporting a printing cylinder carrying data and/or images to be printed. The adapter sleeve has an internal layer defining a bore enabling the sleeve to be mounted onto a rotary mandrel of a printing machine. Each opposite extreme end of the adapter sleeve includes a rigid, load-bearing, radial spacer member disposed between the layers to provide rigidity and indeformability during the use of the sleeve with time. The inner surface of each of the extreme end radial spacer members is defined by rigid and non-deformable material of very low coefficients of dynamic and static friction.

23 Claims, 12 Drawing Sheets

(56) References Cited

U.S. PATENT DOCUMENTS

| | | | | |
|---|---|---|---|---|
| 2003/0217661 | A1* | 11/2003 | Schnieders | 101/376 |
| 2004/0079250 | A1* | 4/2004 | Lorig et al. | 101/375 |
| 2004/0103804 | A1* | 6/2004 | McLean et al. | 101/375 |
| 2005/0061177 | A1* | 3/2005 | Salvestro et al. | 101/376 |
| 2006/0032388 | A9* | 2/2006 | Belanger et al. | 101/375 |
| 2006/0096478 | A1* | 5/2006 | Marchini | 101/375 |
| 2006/0137551 | A1* | 6/2006 | Piolat | 101/375 |
| 2007/0144381 | A1* | 6/2007 | Lorig et al. | 101/375 |
| 2007/0256583 | A1* | 11/2007 | Ahler et al. | 101/375 |

* cited by examiner

HIGH-RIGIDITY ADAPTER SLEEVE FOR PRINTING CYLINDERS

CROSS-REFERENCE TO RELATED APPLICATIONS

The present application hereby claims priority to currently pending Italian Application Serial Number MI2008A002225 filed Dec. 16, 2008.

STATEMENT REGARDING FEDERALLY SPONSORED RESEARCH OR DEVELOPMENT

N/A

BACKGROUND OF THE INVENTION

The present invention relates to a bridge sleeve that itself can be air mounted to the mandrel of a printing machine in the flexographic or rotogravure printing field and that permits air mounting of a printing cylinder onto the bridge sleeve.

In the flexographic or rotogravure printing field, it is known to use an adapter sleeve (aka bridge sleeve) that is disposed between a rotary mandrel of the printing machine and an actual printing cylinder carrying the data and/or images that are to be printed. The use of an adapter sleeve such as disclosed in commonly owned U.S. Pat. No. 5,782,181, which is hereby incorporated herein in its entirety for all purposes, enables various print developments to be achieved with the same rotary mandrel, without the need to replace this latter (generally of steel, hence costly and heavy) following a change in print development compared with the previous work carried out on the same printing machine.

Various methods are known for mounting a conventional adapter sleeve (defined by a hollow cylinder with a through hole) onto a rotary mandrel of a printing machine. While mounting systems employing hydraulics and mounting systems employing mechanical connections are known, these typically are more cumbersome and heavier than a much used "air mounting" system in which a conventional adapter sleeve that has an inner surface diameter slightly smaller than the diameter of the outer surface of the mandrel. The difference between these diameters enables an interference fit to be achieved between the mandrel of the printing machine and the conventional adapter sleeve. Positioning the conventional adapter sleeve at one end of the mandrel, compressed air is supplied (by known methods) between the outer surface of the mandrel and the inner surface of the adapter sleeve. The compressed air expands the inner surface of the conventional adapter sleeve sufficiently to allow the adapter sleeve to slide over a cushion of air onto the mandrel. When the supply of compressed air is ended, the inner surface of the conventional adapter sleeve shrinks and grips the outer surface of the mandrel in an interference fit between the mandrel and the conventional adapter sleeve. Similarly, by again feeding compressed air onto the mandrel surface, the conventional adapter sleeve can be slightly widened to enable it to be released from the interference fit and removed from the mandrel.

Air-mountable adapter sleeves such as disclosed in commonly owned U.S. Pat. Nos. 5,819,657; 6,688,226; and 6,691,614, each of which being hereby incorporated herein in its entirety for all purposes, is usually made with a multi-layer body comprising at least one elastically compressible and radially deformable layer running the length of the adapter sleeve. The compressed air acting against the inner surface of such an adapter sleeve compresses this elastically compressible and radially deformable layer, which can be made of polyurethane foam, to enable the inner surface of the adapter sleeve to expand radially as it is being mounted on the outer surface of the mandrel.

However this elastic characteristic, although enabling the conventional adapter sleeve to be air-mounted on the mandrel, works at cross purposes with the need for the adapter sleeve's outer surface to remain as rigidly fixed as possible with respect to the mandrel of the printing machine in order to resist the vibrations that are generated during operation of the printing machine. When the mandrel of such a printing machine rotates at speeds necessary to advance the substrate through the printing machine at line speeds of more than about 250 meters/minute, the presence of the elastically compressible and radially deformable layer in a conventional adapter sleeve permits the machine vibrations to cause radial displacements of the adapter sleeve's outer surface with respect to the mandrel. These radial displacements are more likely to arise the larger the sleeve's length and diameter. When these radial displacements do arise, they compromise print quality to an unacceptable level by causing banding or skipping. Nonetheless, printing machines that generate line speeds exceeding 250 meters/minute are becoming the norm, and a need exists for air-mountable adapter sleeves that produce acceptable print quality.

When a conventional adapter sleeve is mounted on the mandrel of a printing machine, it becomes possible to draw the printing cylinder onto the outer surface of this conventional adapter sleeve by feeding pressurized air beneath the printing cylinder in a manner similar to the mounting of the inner surface of the adapter sleeve onto the outer surface of the printing machine's mandrel. Depending on the way that a conventional adapter sleeve supplies pressurized air to the adapter sleeve's outer surface and beneath the printing cylinder, the conventional adapter sleeve can be classified by either the designation "piped" or the designation "flow through."

A piped adapter sleeve receives the pressurized air via a connector that is fitted to the adapter sleeve during mounting of the printing sleeve and then disconnected from the adapter sleeve before the printing process begins. The pressurized air reaches the outer surface of the piped adapter sleeve through one or more conduits that run axially through the adapter sleeve before being connected to holes through the outer surface of the adapter sleeve.

A flow through adapter sleeve has a plurality of through holes, which may open for example into its inner surface, but always open into its outer surface. The through holes receive the pressurized air from the printing machine's mandrel. This transfer of pressurized air from the mandrel to the adapter sleeve can be accomplished in several ways known in the art. For example, a groove can be defined circumferentially in the outer surface of the mandrel so as to be positioned beneath the through holes in the adapter sleeve. Pressurized air from within the mandrel is supplied via at least one hole emptying into the groove in the mandrel. Alternatively, a groove can be defined circumferentially in the inner surface of the adapter sleeve so as to be positioned above the through holes in the mandrel (or the groove in the mandrel) from which pressurized air is supplied and thence to the through holes in the adapter sleeve. Moreover, any of the foregoing groove and hole arrangements can be supplied on only one end of the adapter sleeve and on one end of the mandrel or alternatively can be provided on both ends of the adapter sleeve and/or the mandrel.

OBJECTS AND BRIEF SUMMARY OF THE INVENTION

An object of the present invention is therefore to offer an improved adapter sleeve that is easy to mount on the mandrel using compressed air, while at the same time having high rigidity so as not to deform unacceptably during its use on the printing machine.

Another object is to offer an improved piped adapter sleeve of the aforesaid type which is of low weight and simple construction.

Another object is to offer an improved flow through adapter sleeve of the aforesaid type which is of low weight and simple construction.

These and other objects which will be apparent are attained by an improved adapter sleeve in accordance with the description herein.

The adapter sleeves of the present invention have in common the elimination of the elastically compressible and radially deformable layer of a conventional adapter sleeve. At each extreme end of the adapter sleeve there is an end radial spacer member formed of rigid material. The inner surface of each end radial spacer member defines a bore with the same diameter as the outer surface of the mandrel of the intended printing machine. The inclusion of these radial spacer members assures that the radial distance between the adapter sleeve's outer surface and the surface of the mandrel of the printing machine remains as rigidly fixed as possible, even at line speeds well in excess of 600 meters per minute. While this inner surface of each end radial spacer member is not expandable, this inner surface is formed of material of very low static and dynamic friction coefficients and thereby ensures the ability to slide the end radial spacer members of the adapter sleeve onto the mandrel of the intended printing machine.

The adapter sleeves of the present invention also have in common an internal first layer formed as a cylinder and defining an inner bore with a diameter that is slightly less than the diameter of the mandrel of the intended printing machine. The internal first layer is slightly expandable and thus ensures the ability to expand the inner bore sufficiently by the application of pressurized air to the inner bore defined by the internal layer to slide the internal layer, and thus the adapter sleeve, onto the mandrel. When the pressurized air is turned off, the internal first layer is resilient enough so that the diameter of the inner bore constricts enough to assure that the adapter sleeve is fixed against axial and circumferential displacement with respect to the surface of the mandrel.

BRIEF DESCRIPTION OF THE DRAWINGS

The present invention will be better understood from the accompanying drawings, which are provided by way of non-limiting example and in which.

DETAILED DESCRIPTION OF PRESENTLY PREFERRED EMBODIMENTS

Reference now will be made in detail to the presently preferred embodiments of the invention, one or more examples of which are illustrated in the accompanying drawings. Each example is provided by way of explanation of the invention, which is not restricted to the specifics of the examples. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

The present invention lends itself to piped embodiments and flow through embodiments of adapter sleeves, and examples of both types are described below.

Figure 1:
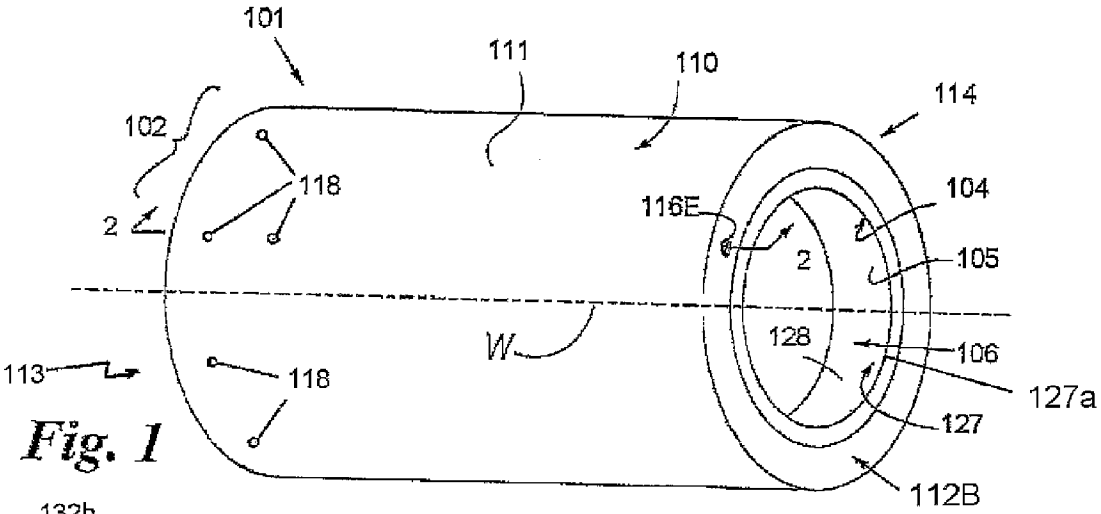
FIG. 1 is a perspective view of an embodiment of the invention.
Figure 2:
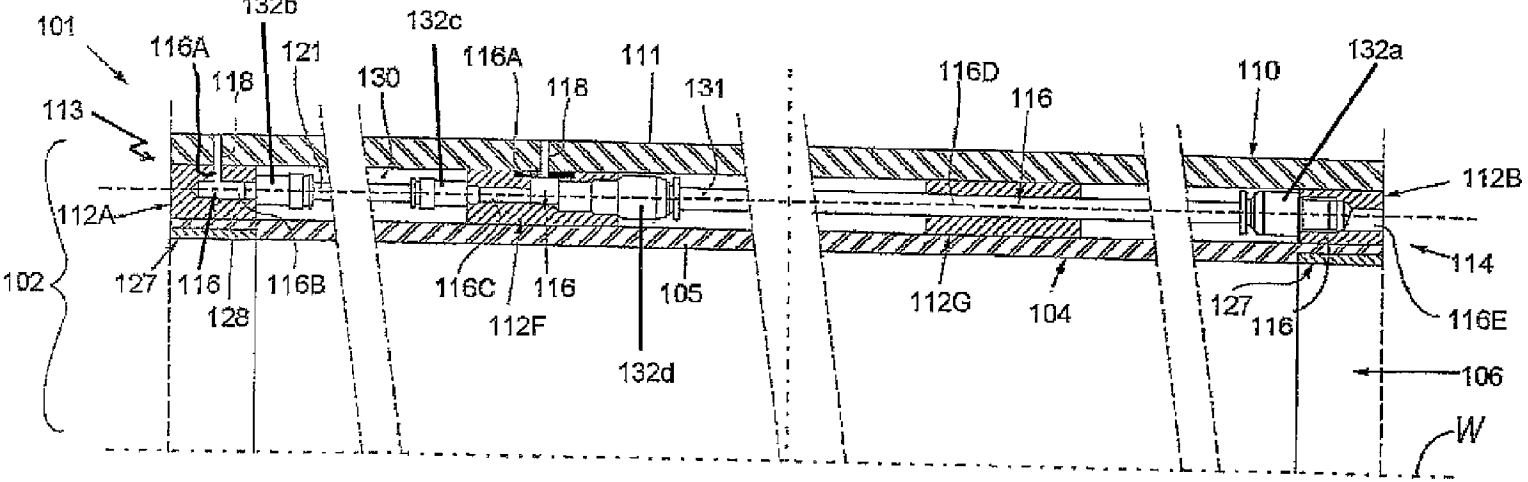
FIG. 2 is a partial longitudinal cross section taken along the line designated 2-2 in FIG. 1.
Figure 3:
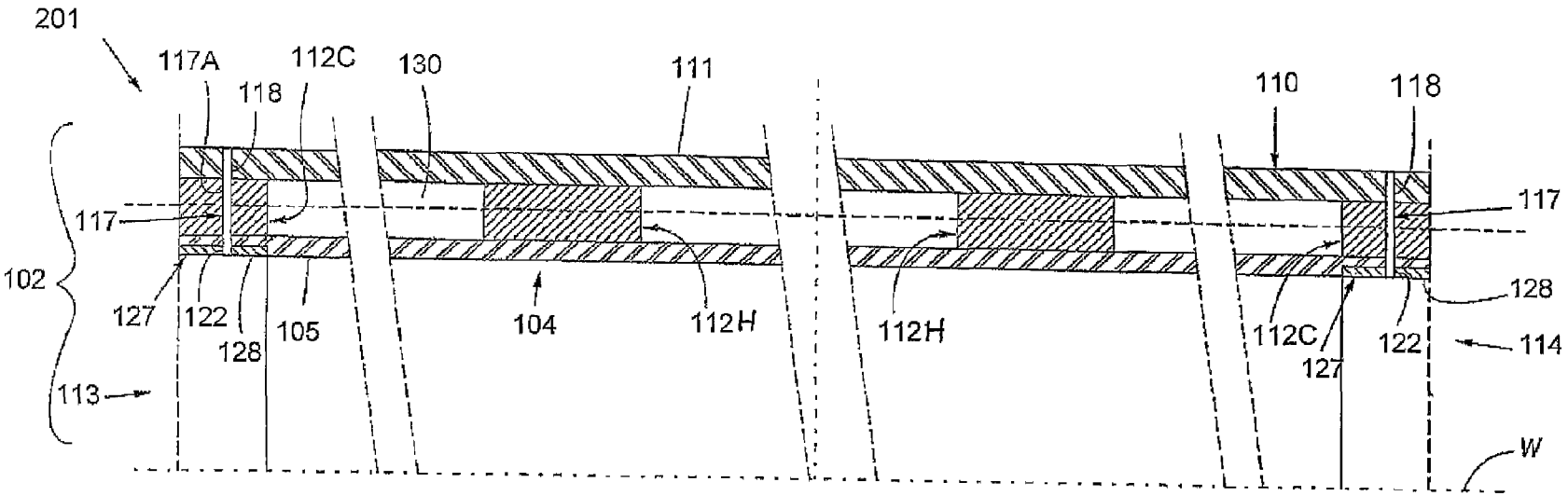
FIG. 3 is a view similar to that of FIG. 2, but showing another embodiment of the invention.
Figure 7:
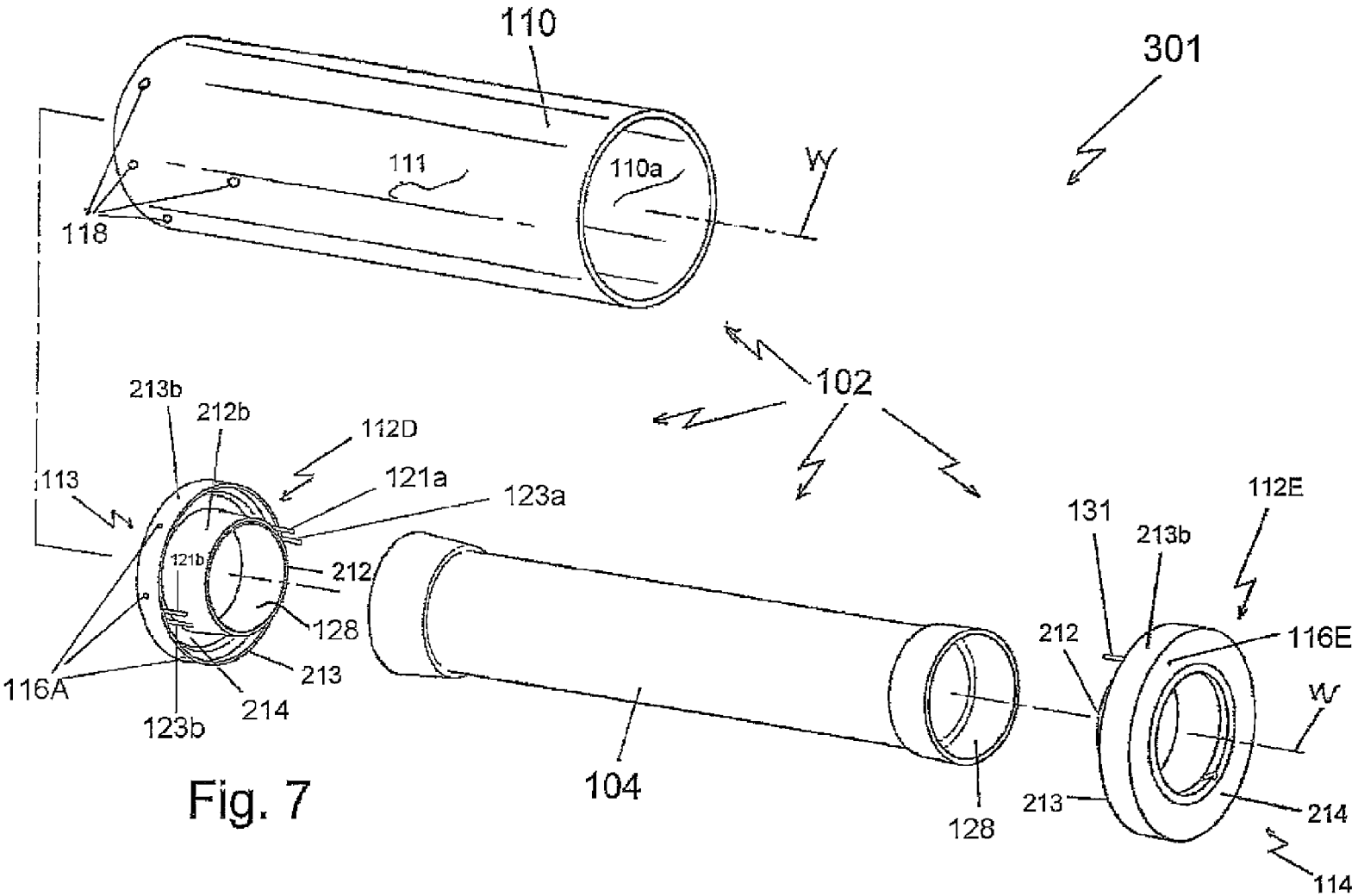
FIG. 7 is a perspective view of assembly of components of another embodiment of the invention also shown in FIG. 8.
Figure 8:
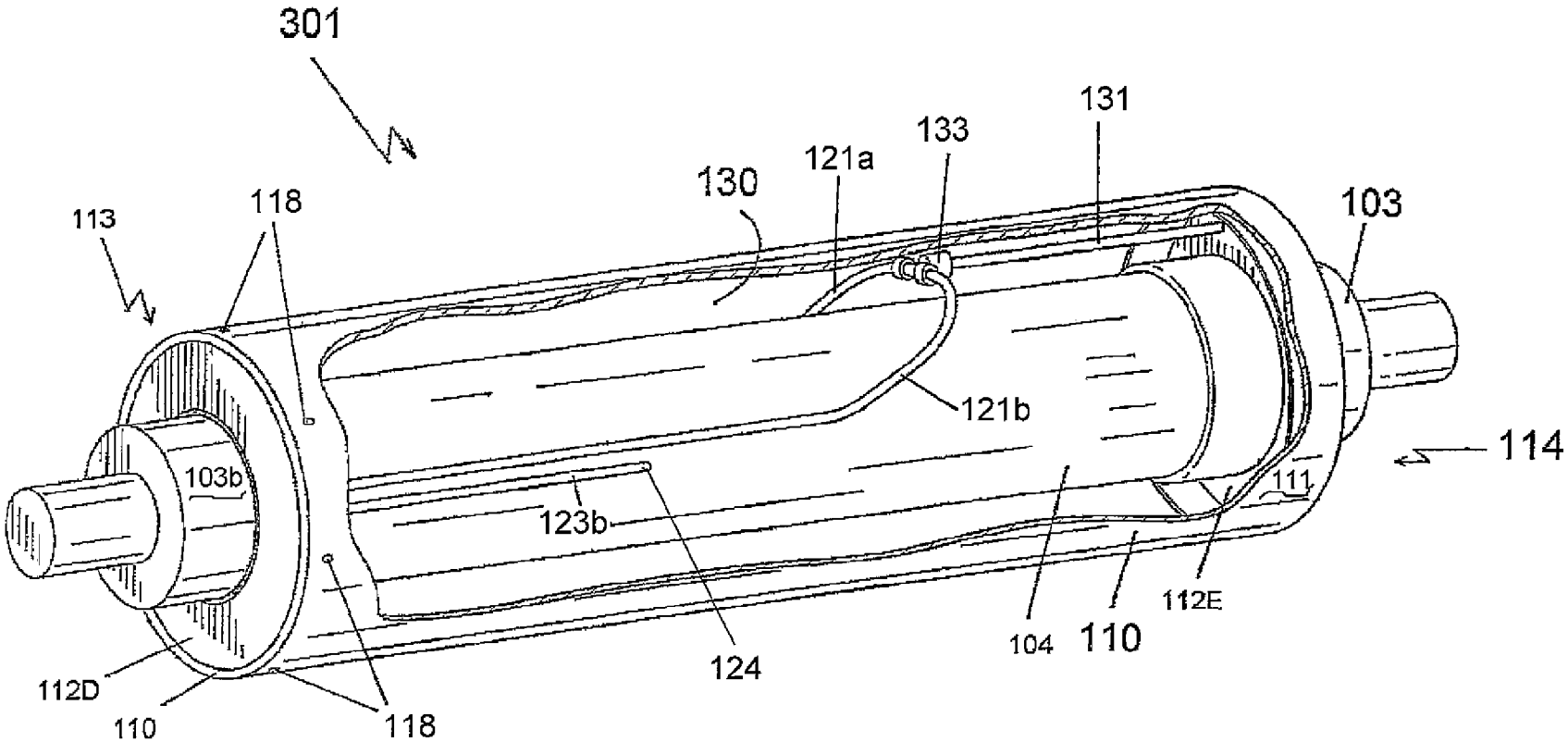
FIG. 8 is a perspective view of assembled components (with portions cut away) of another embodiment of the invention mounted on a mandrel of a printing machine.

FIGS. 1 and 2 illustrate an embodiment of a piped adapter sleeve generally designated overall by the numeral 101, while FIGS. 7 and 8 illustrate another embodiment of a piped adapter sleeve generally designated overall by the numeral 301. FIG. 3 illustrates an embodiment of a flow through adapter sleeve generally designated overall by the numeral 201. Each of the adapter sleeves 101, 201, 301 comprises a cylindrical body 102 of layered type. This body 102 comprises an internal first layer 104 defining with its inner surface 105 (i.e. that closest to the longitudinal axis W of the body 102) an inner bore 106 enabling the sleeve 101 to be mounted on a rotary mandrel 103 (only shown in FIG. 8) of a printing machine (not shown). The inner bore 106 can be configured as a right cylinder or can be tapered in a conical shape, the latter enabling the adapter sleeve 101, 201, 301 to fit onto a tapered mandrel.

The internal layer 104 of the body 102 is made primarily of an expandable material of high rigidity, enabling this internal layer 104 to undergo repeated radial expansion and contraction without negative consequences for the interference fit with the outer surface of the printing machine's mandrel with which this internal layer 104 is in contact when the adapter sleeve 101, 201, 301 is mounted on the mandrel. The degree of radial expansion and contraction must not be so large as to be detectable with the naked eye.

Examples of the material composing the internal layer 104 can be, but are not limited to, aramid fibre bonded with epoxy resin or polyester resin; polymer material reinforced with hardened glass fibre bonded with epoxy resin or polyester resin, this material also being known as glass fibre-reinforced epoxy resin or glass fibre-reinforced polyester resin; material known by the brand name of MYLAR; or material known by the brand name of KEVLAR. These indications are given by way of non-limiting example.

The body 102 of the adapter sleeve 101, 201, 301 comprises an external layer 110 having an outer surface 111 on which a printing cylinder, which carries the data and/or images to be reproduced on a suitable support (both not shown), can be mounted. This external layer 110 is composed of rigid material that is not expandable by pressurized air, i.e., a material having a Shore D hardness between about 80 and about 95. For example, this external layer 110 can be made of carbon fibre bonded with epoxy resin, or rigid polyurethane or fibreglass reinforced polyester resin or metal.

In the embodiments shown in each of FIGS. 2, 3 and 8 for example, between the internal layer 104 and the external layer 110 there are radial spacer members, which are designated by the numeral 112 followed by a letter designation (A, B, C, etc) that distinguishes between radial spacer members 112 having different configurations. Each of the radial spacer members 112 is composed of rigid material (with hardness between about 80 and about 95 Shore D). Examples of materials suitable for radial spacer members 112 includes machined aluminium or carbon fibre bonded with epoxy resin. The radial spacer members 112 composed of carbon fibre bonded with epoxy resin desirably can be formed in a vacuum molding process.

Figure 5:
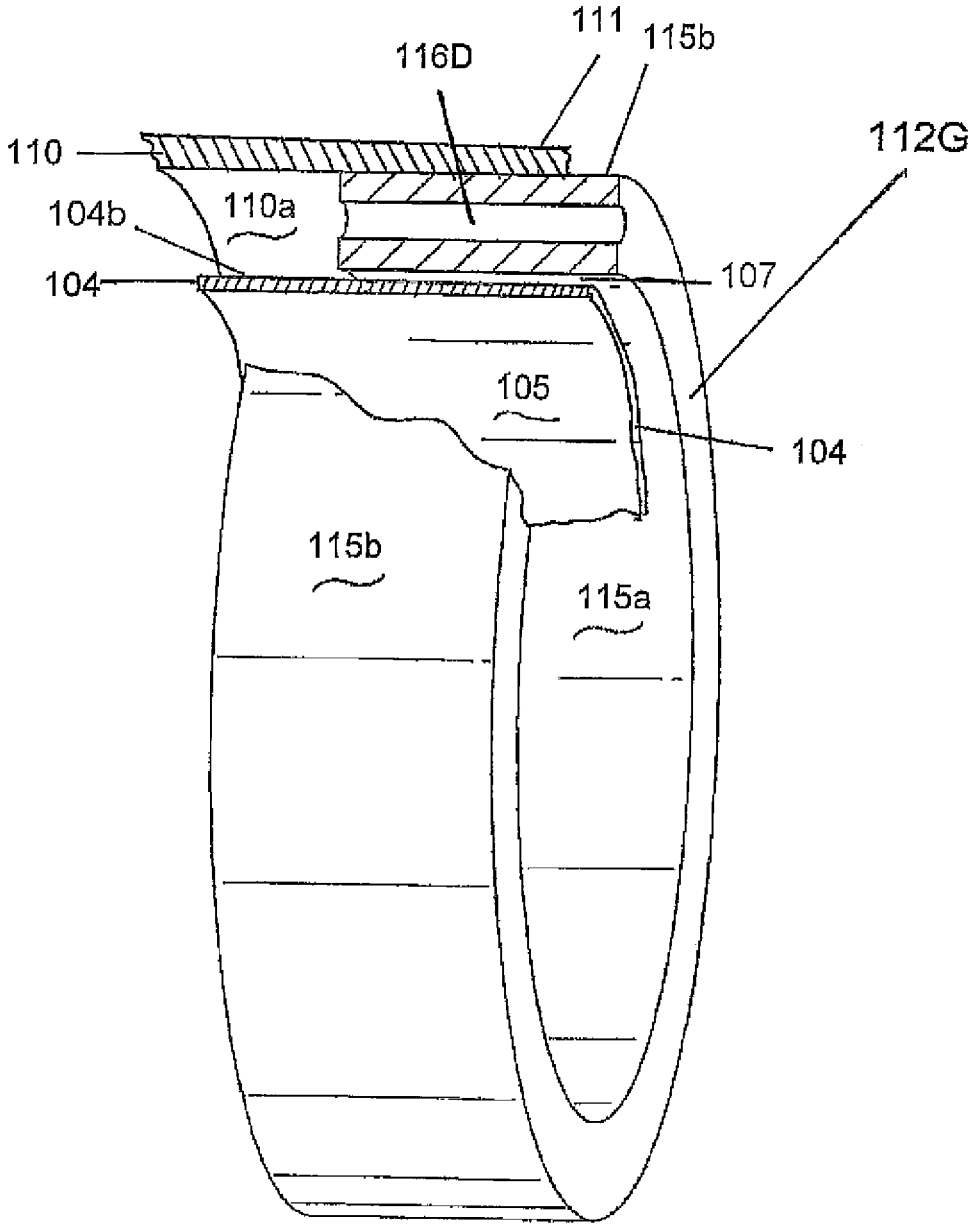
FIG. 5 is a perspective view with portions cut away and portions shown in cross section of components of an embodiment of the invention.
Figure 6:
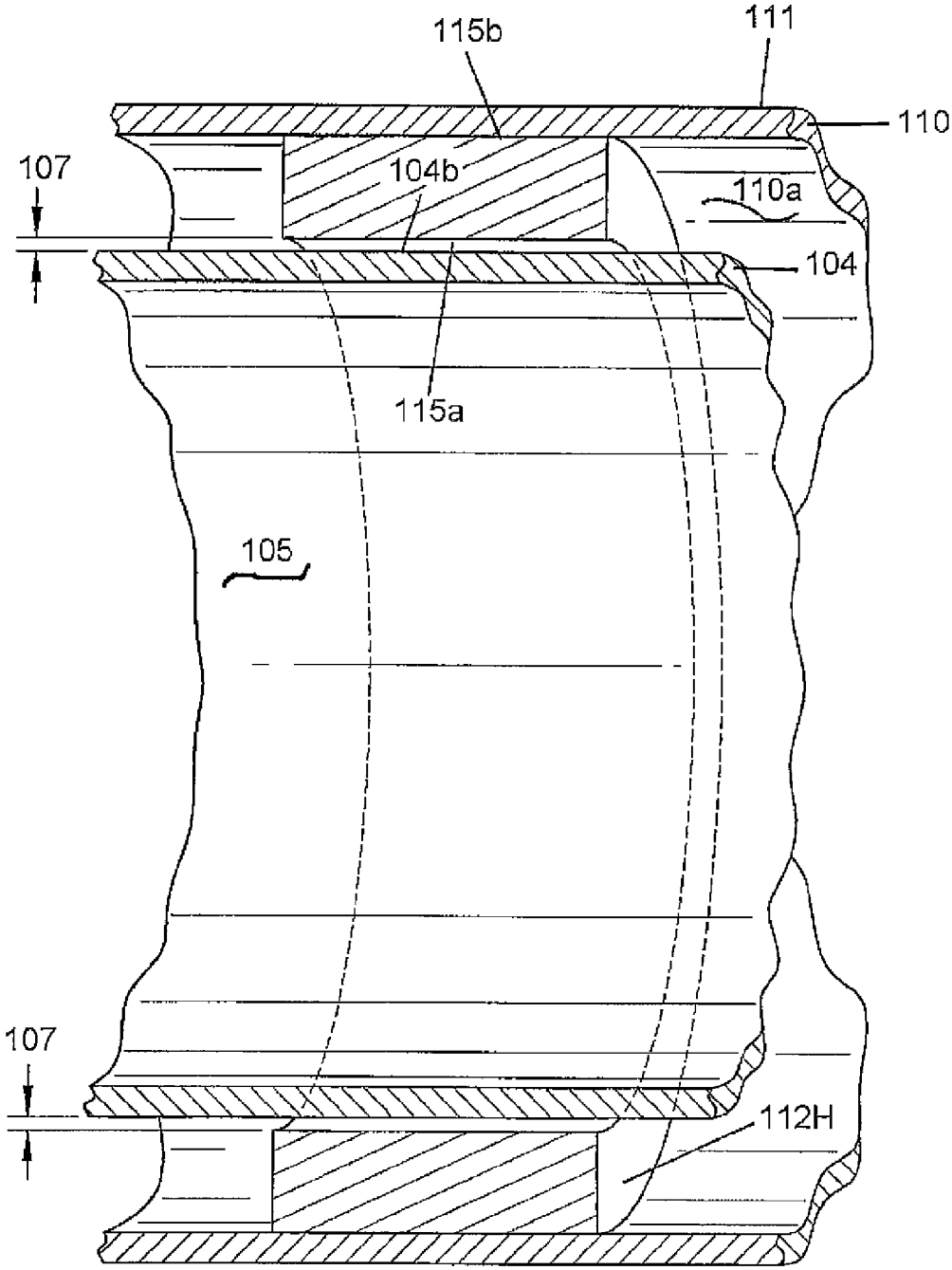
FIG. 6 is a perspective view with portions cut away and portions shown in cross section of components of an embodiment of the invention.

In the embodiments shown in each of FIGS. 2 and 3 for example, the rigid, load-bearing, radial spacer members 112 desirably are configured as annular rings that extend radially between the internal layer 104 and the external layer 110 and circumferentially within an empty space 130 present between the two layers 104, 110. Each of the radial spacer members 112 in the embodiments shown in each of FIGS. 2-6 desirably is configured with the axial length (measured in the direction parallel to the sleeve's longitudinal axis W) of the larger diameter outer surface equal to the axial length of the smaller diameter inner surface, and this axial length desirably is on the order of 2.5 cm. As shown in FIGS. 5 and 6 for example, the axial length of the larger diameter outer support surface 115*b* equals the axial length of the smaller diameter inner surface 115*a* for each respective intermediate radial spacer member 112G, 112H.

Figure 12:
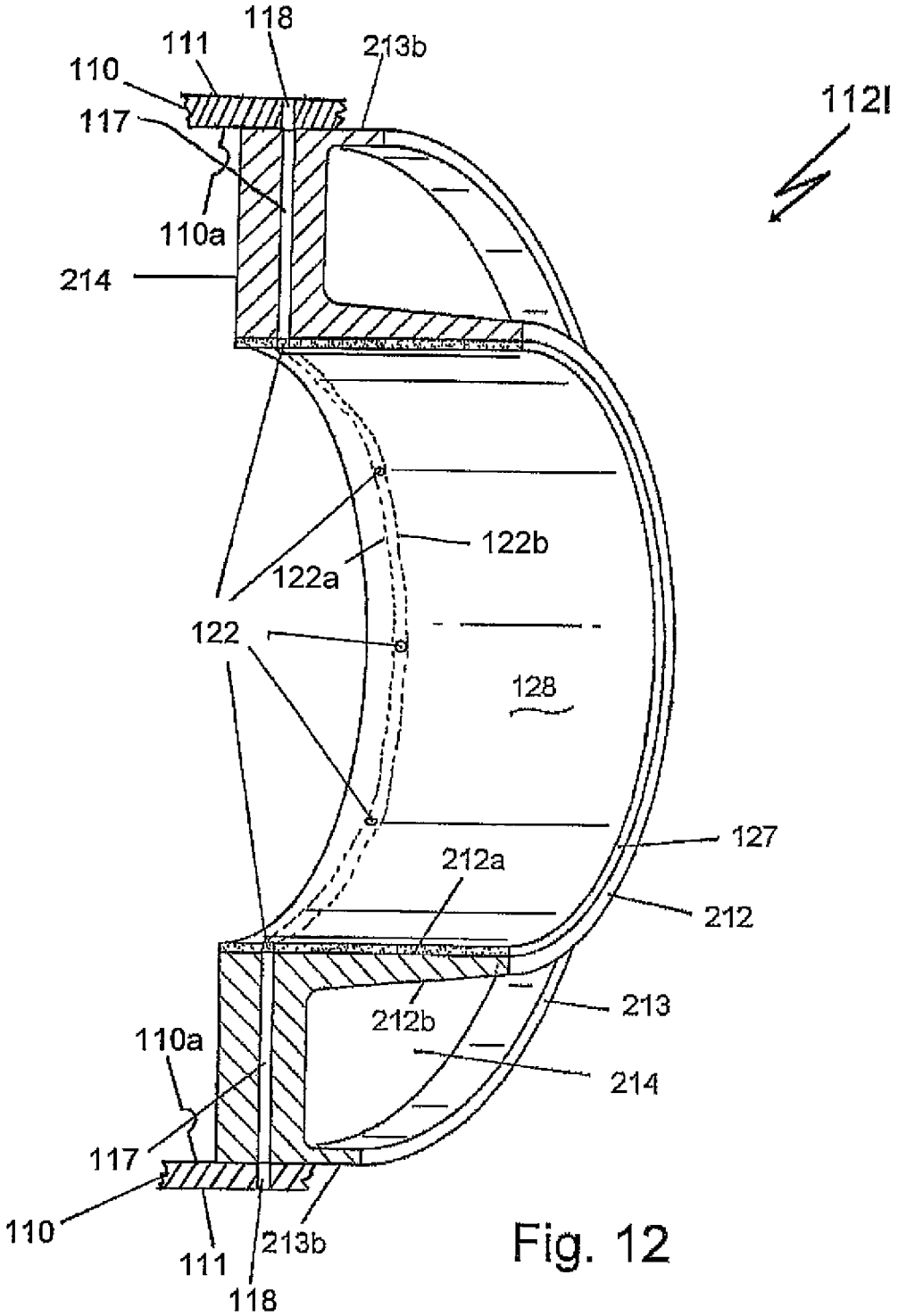
FIG. 12 is a partial longitudinal cross section taken along a line similar to the one designated 10-10 in FIG. 9.

As shown in FIG. 2, at least one of these load-bearing radial spacer members 112 is a blind end radial spacer member 112A positioned desirably at one of the opposing ends 113 of the piped adapter sleeve 101, and at least a second one of these load-bearing radial spacer members 112 is an open end radial spacer member 112B positioned desirably at the other one of the opposing ends 114 of the piped adapter sleeve 101. As shown in FIG. 3, in a flow through embodiment of an adapter sleeve 201, both end radial spacer members 112C have the same configuration. FIG. 12 shows an alternative embodiment of an end radial spacer member 112I for a flow through embodiment of an adapter sleeve in accordance with the present invention. In an embodiment as shown in FIGS. 7 and 8 for example, at least one of these load-bearing radial spacer members 112 desirably is a blind end radial spacer member 112D positioned at one of the opposing ends 113 of an embodiment of a piped adapter sleeve 301, and at least a second one of these load-bearing radial spacer members 112 desirably is an open end radial spacer member 112E positioned at the other one of the opposing ends 114 of the piped adapter sleeve 301.

Figure 9:
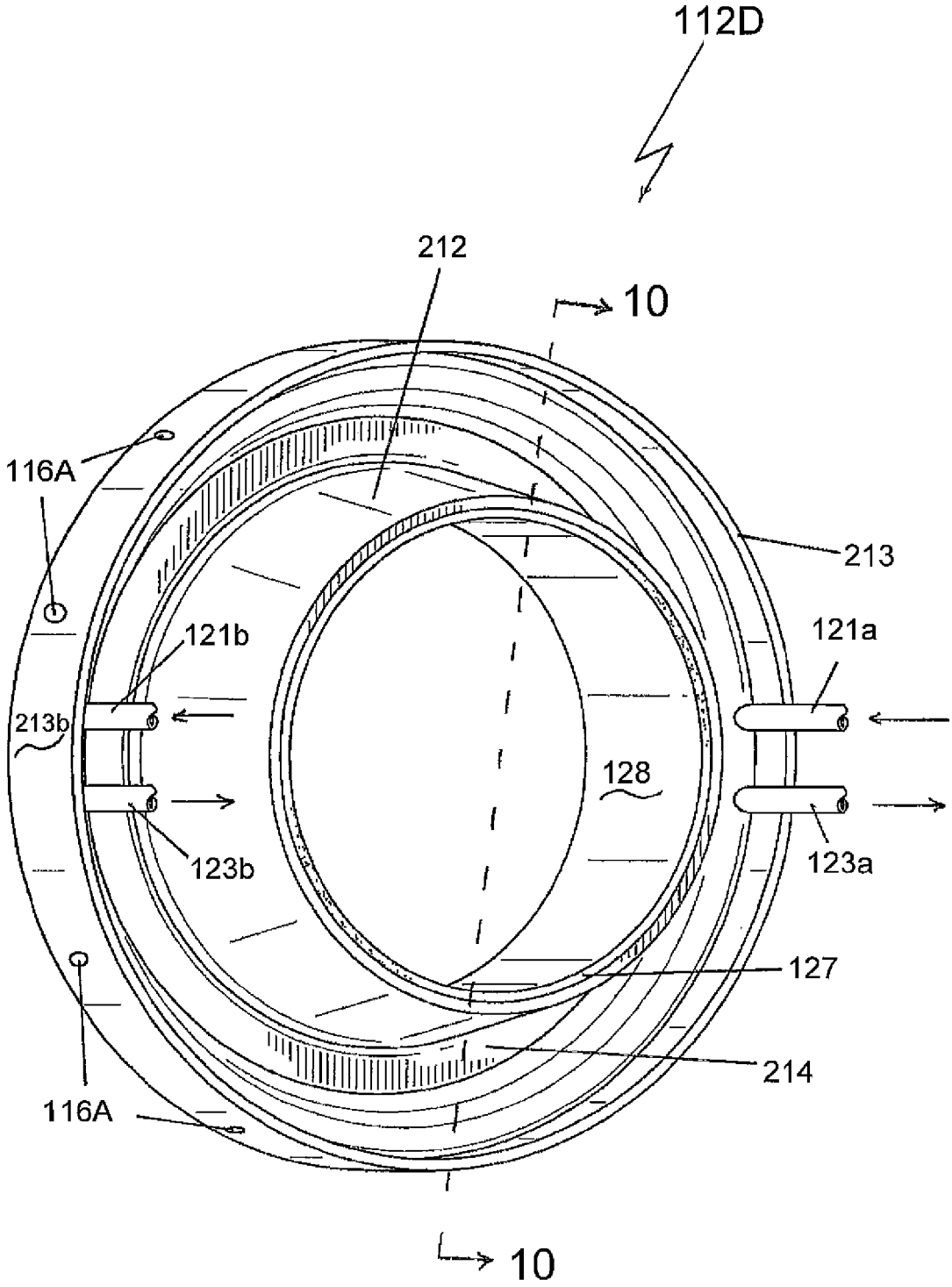
FIG. 9 is a perspective view of a component of an embodiment of the invention.
Figure 10:
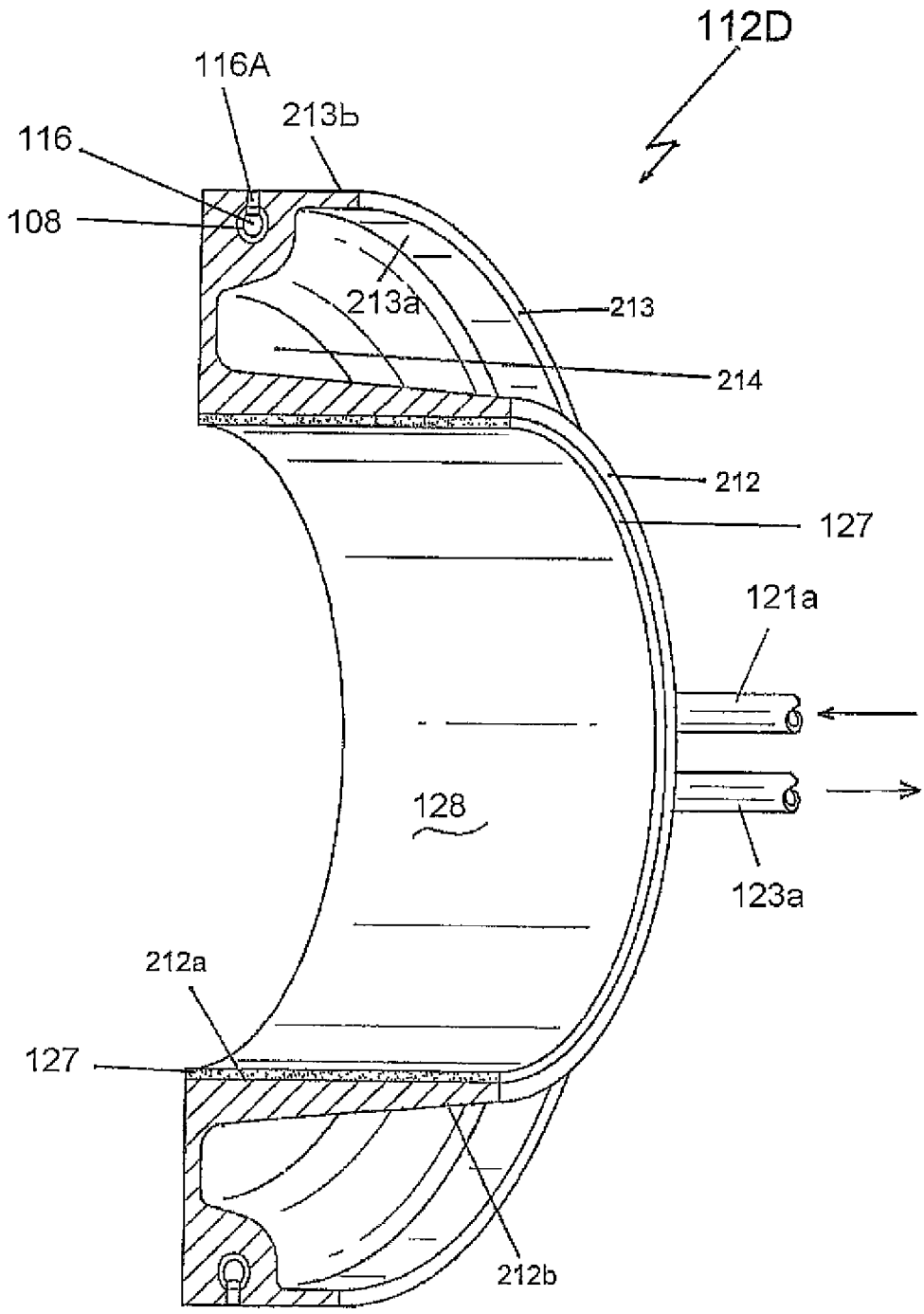
FIG. 10 is a partial longitudinal cross section taken along the line designated 10-10 in FIG. 9.

In the embodiments shown in each of FIGS. 8, 9 and 10 for example, each of these rigid, load-bearing, end radial spacer members 112D, 112E desirably is configured to define an inner flange 212, an external flange 213 and a radially extending web 214 rigidly connecting the inner flange 212 to the external flange 213. In practice, the inner flange 212, the external flange 213 and the radial web 214 are formed as a unitary structure as by vacuum molding. As shown in FIG. 10 for example, each inner flange 212 and each external flange 213 extends axially from the same side of the radial web 214. As shown in FIG. 7 each inner flange 212 extends axially toward the interior of the piped adapter sleeve 301. As similarly shown in FIG. 7 each external flange 213 extends axially toward the interior of the piped adapter sleeve 301.

As shown in FIG. 10 for example, each inner flange 212 defines an inner annular surface 212*a* and an outer annular surface 212*b*. In an adapter sleeve 301 intended for a printing machine with tapered mandrels, the inner bore defined by the inner annular surface 212*a* will be tapered and thus have a slightly conical shape. As shown in FIG. 10 for example, each external flange 213, defines an internal annular surface 213*a* and an external annular surface 213*b*. As shown in FIG. 7 for example, the blind end radial spacer member 112D is spaced axially apart from the open end radial spacer member 112E such that the flanges 212, 213 of the blind end radial spacer member 112D extend axially toward the open end radial spacer member 112E, and the flanges 212, 213 of the open end radial spacer member 112E extend axially toward the blind end radial spacer member 112D.

Figure 11:
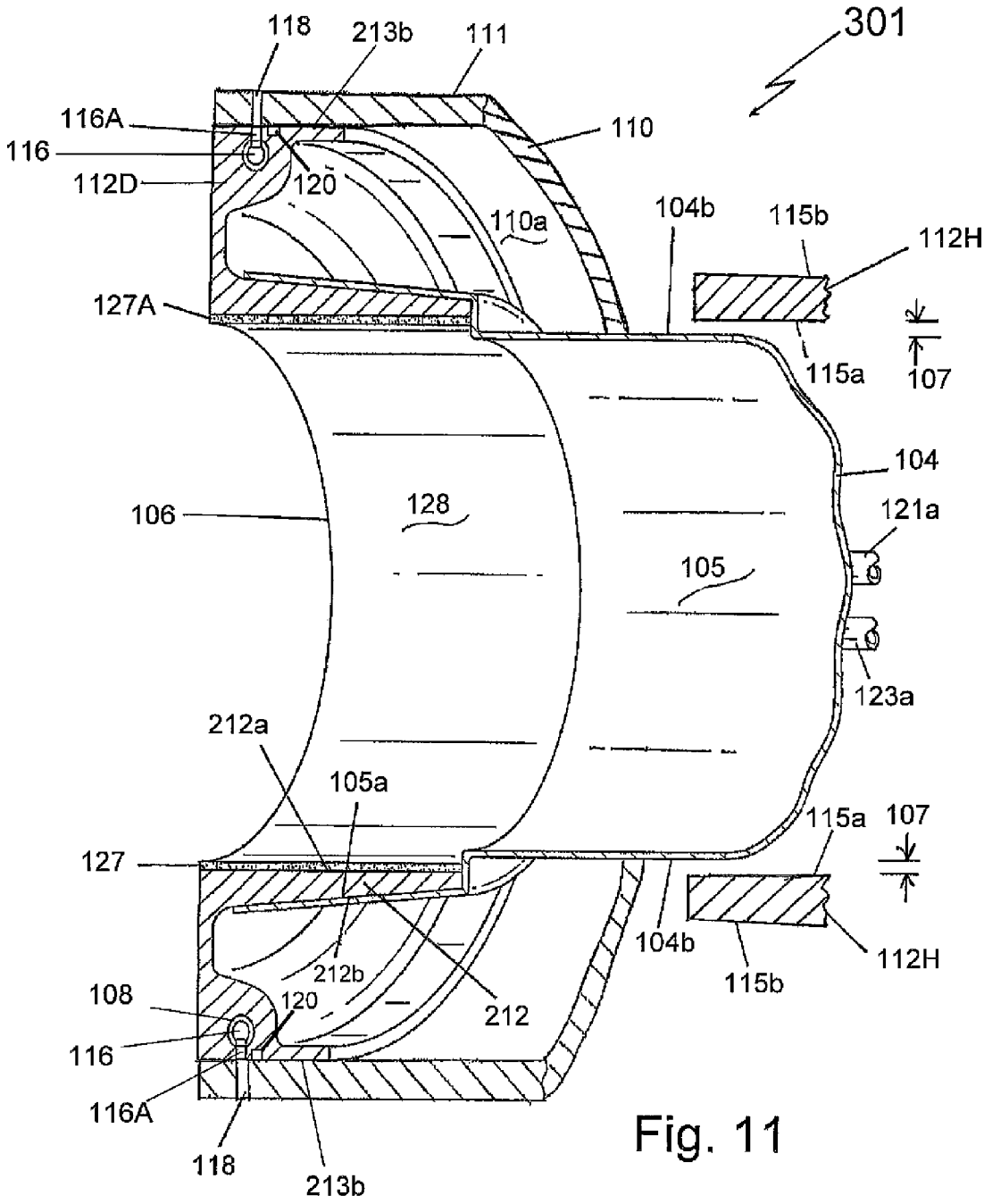
FIG. 11 is a perspective view with portions cut away and portions shown in cross section of components of an embodiment of the invention.

The external layer 110 desirably is fixed rigidly and permanently to the radial spacer members 112 by having the inner facing surface of the external layer 110 glued to the outer supporting surfaces 213*b* of the radial spacer members 112. In the embodiment shown in an assembly view in FIG. 7 and in a partial cross sectional view shown in FIG. 11 for example, the inner facing surface 110*a* of the external layer 110 desirably is fixed rigidly and permanently to the end spacer members 112D, 112E by having the inner facing surface 110*a* of the external layer 110 glued desirably by an epoxy resin adhesive to the outer supporting surfaces 213*b* of the external flange 213 of each of the end radial spacer members 112D, 112E. As schematically shown in FIG. 11 for example, a groove 120 desirably is defined into the outer supporting surface 213*b* of the external flange 213, and that groove 120 extends circumferentially completely around the outer supporting surface 213*b*. The extent of the width of the groove 120 (measured in the axial direction of the sleeve) desirably can be longer than is shown in FIG. 11 in order to have more surface contact between the glue and the external layer 110. Coincident with this groove 120, one or more small hole(s) (not shown in FIG. 11) is(are) drilled radially through the external layer 110 to allow the epoxy glue to be injected through such holes and fill the groove 120 to facilitate attachment of the external layer 110 to the end radial spacer member 112.

Figure 4:
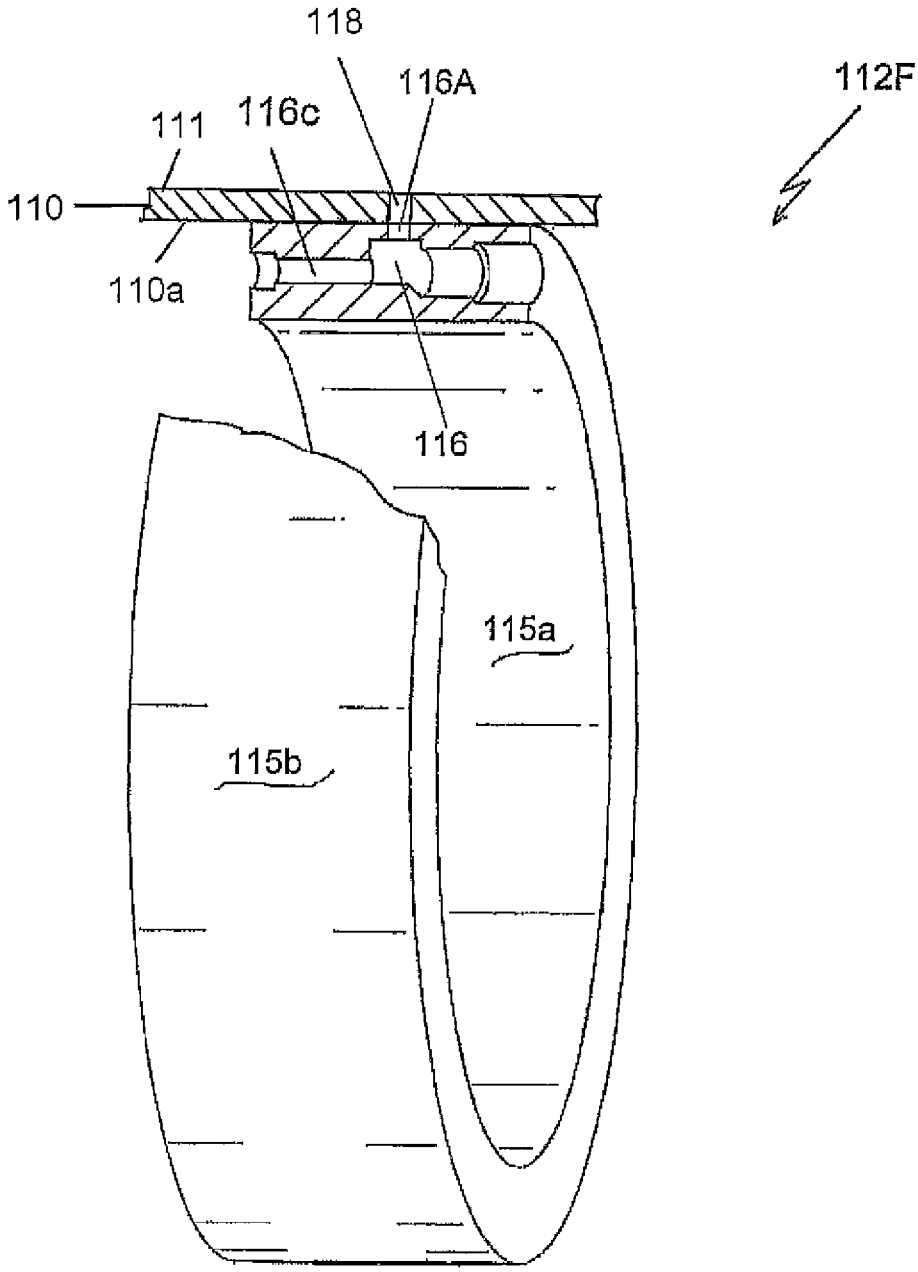
FIG. 4 is a perspective view with portions cut away and portions shown in cross section of a component of an embodiment of the invention.

As shown in FIG. 4 for a triple-connection, intermediate radial spacer member 112F, the inner facing surface 110*a* of the external layer 110 is glued desirably by an epoxy resin adhesive to the outer supporting surfaces 115*b* of the radial spacer member 112F. As shown in FIG. 5 for a double-connection, intermediate radial spacer member 112G, the inner facing surface 110*a* of the external layer 110 is glued to the outer supporting surfaces 115*b* of the radial spacer member 112G desirably by an epoxy resin adhesive. As similarly shown in FIG. 6, the inner facing surface 110*a* of the external layer 110 is glued desirably by an epoxy resin adhesive to the outer supporting surfaces 115*b* of the intermediate radial spacer member 112H. Though not shown in FIGS. 4-6, the same sort of groove 120 as described above and shown in FIG.

11, can be employed to facilitate attachment of the external layer 110 to the end radial spacer members 112F, 112G and 112H.

Adapter sleeves 101, 201, 301 of relatively smaller length and relatively smaller diameter typically need only include a pair of end radial spacer members such as end radial spacer members 112A, 112B in FIGS. 1 and 2, end radial spacer members 112C in FIG. 3, and end radial spacer members 112D, 112E in FIGS. 7 and 8. For adapter sleeves 101, 201, 301 of relatively smaller length and relatively smaller diameter, the end radial spacer members 112 suffice to provide the adapter sleeve with adequate rigidity to prevent the vibrations generated during the use in a printing machine running at line speeds of more than 250 meters per minute from being able to deform the adapter sleeve in a manner that renders the adapter sleeve unusable or causes a reduction in print quality due to deviations in the sleeve's concentricity for example.

However, adapter sleeves 101, 201, 301 of relatively larger diameter and/or relatively larger length desirably will include one or more intermediate radial spacer members 112 at one or more locations disposed axially along the longitudinal axis W of the body 102 in the space 130 between the two layers 104, 110 and between the two end spacer members 112 disposed at opposite ends 113, 114 of the adapter sleeves 101, 201, 301. The concentric rigidity of adapter sleeves 101, 201, 301 of relatively larger diameter and/or relatively larger length can benefit from these intermediate ones of these radial spacer members 112 present at various intermediate locations along the longitudinal axis W of the body 102. The intermediate ones of the load-bearing, radial spacer members 112 desirably are symmetrically positioned axially within the empty space 130 present between the internal layer 104 and the external layer 110.

Depending on the length and diameter of the piped adapter sleeve 101, 301, it may be desirable to include a double-connection, intermediate radial spacer member 112G, an example of which configured for piped adapter sleeve 101 being shown in FIGS. 2 and 5 for example. As shown in FIGS. 2 and 4 for example, for piped adapter sleeves of still longer length and/or larger diameter, a triple-connection, intermediate radial spacer member 112F desirably is disposed closer to the end 113 of the adapter sleeve 101 where the blind end radial spacer member 112A is located. As shown in FIG. 2 for example, in an embodiment including a triple-connection, intermediate radial spacer member 112F, a double-connection, intermediate radial spacer member 112G desirably is disposed closer to the end 114 of the adapter sleeve 101 where the open end radial spacer member 112B is located. As shown in FIGS. 3 and 6 for example, for flow through adapter sleeves 201 of relatively longer length and/or relatively larger diameter, one or more intermediate radial spacer members 112H desirably is/are disposed axially between the two end radial spacer members 112C in various intermediate regions along the longitudinal axis W of the body 102. As shown in FIGS. 3 and 6 for example, each of these additional intermediate load-bearing spacer members 112H can be formed as a unitary solid.

As with the end radial spacer members 112A, 112B, 112C, 112D and 112E, and as shown in FIGS. 4, 5 and 6 for example, the outer support surfaces 115*b* of the intermediate radial spacer members 112F, 112G and 112H are permanently attached by adhesives to the inner facing surface 110*a* of the external layer 110. However, in accordance with one aspect of the present invention, and as shown for example in FIGS. 5, 6 and 11, none of the inner surfaces 115*a* of the intermediate radial spacer members 112 is connected or attached to the outer surface 104*b* of the internal layer 104. Instead, in accordance with one aspect of the present invention, there is a very small (on the order of fractions of a millimeter) radial expansion gap 107 between the inner surfaces 115*a* of the intermediate radial spacer members 112 and the outer surface 104*b* of the internal layer 104. For example, on an adapter sleeve measuring 6 inches in diameter at the outer surface 111 of the external layer 110 of the body 102, the radial expansion gap 107 measures from about 2 thousandths of an inch to about 4 thousandths of an inch. The presence of this radial expansion gap 107 ensures that the diameter of the inner surface 105 of the internal layer 104 of the adapter sleeve 101, 201, 301 of the present invention has enough room in which to be free to expand diametrically sufficiently under the application of air pressure to slide over the outer surface of the printing machine's mandrel and then upon removal of the air pressure be free to contract diametrically sufficiently to grip the outer surface of the mandrel in an interference fit that prevents both axial movement and circumferential movement of the internal layer 104 with respect to the printing machine's mandrel, even when the printing machine is in operation and running at line speeds exceeding 600 meters per minute.

In accordance with one aspect of the present invention, only the two load-bearing end radial spacer members 112 positioned at the two opposing ends 113, 114 of an adapter sleeve 101, 201 or 301 are connected to the extreme opposite ends of the internal layer 104. In the adapter sleeve 101 shown in FIG. 2, the outer annular surface of one extreme end of the internal first layer 104 is glued to the inner annular surface of the end radial spacer member 112A, and the outer annular surface of the opposite extreme end of the internal first layer 104 is glued to the inner annular surface of the end radial spacer member 112B. As shown in FIG. 3, the outer annular surface of one extreme end of the internal first layer 104 is glued to the inner annular surface of the end radial spacer member 112C at one end 113 of the adapter sleeve 201, and the outer annular surface of the opposite extreme end of the internal first layer 104 is glued to the inner annular surface of the end radial spacer member 112C at the opposite end 114 of the adapter sleeve 201.

Figure 13:
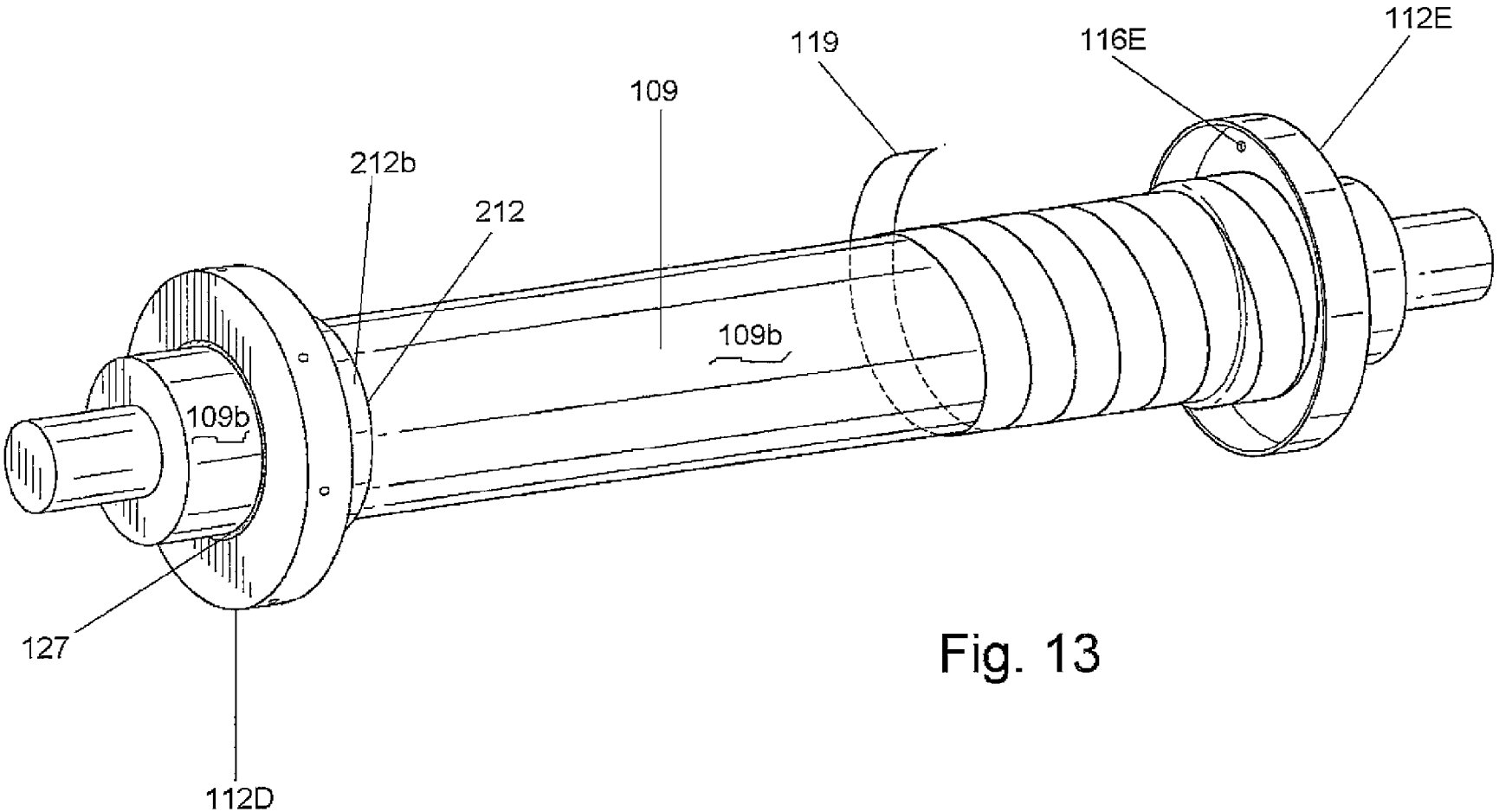
FIG. 13 is a perspective view of illustrating steps performed in making components of an embodiment of the present invention.

As shown in FIG. 11 for example, one extreme end 105*a* of the inner surface 105 of the internal first layer 104 of the adapter sleeve 301 is permanently fixed to the outer surface 212*b* of the inner flange 212 of the blind end radial spacer member 112D. Though not shown in FIG. 11, the opposite extreme end of the inner surface 105 of the internal first layer 104 of the adapter sleeve 301 is permanently fixed to the outer surface 212*b* of the inner flange 212 of the open end radial spacer member 112E. As shown in FIG. 13 for example, a strip 119 of glass fibre lining having been dipped in a bath (not shown) of epoxy resin (or the like) desirably is wound around the outer surface 212*b* of one of the end radial spacer members 112D, 112E and then around the outer surface 109*b* of a forming mandrel 109, which outer surface 109*b* has a diameter that is slightly undersized relative to the diameter of the mandrel of the printing machine on which the adapter sleeve 101, 201 is to be mounted. The strip 119 of glass fibre lining imbued with epoxy resin (or the like) is then finally wound around the outer surface 212*b* of the other one of the end radial spacer members 112D, 112E. The internal first layer 104 is thus formed with each of its opposite ends permanently attached to one of the end radial spacer members 112D, 112E and the inner surface with a diameter slightly smaller than the diameter of the mandrel of the intended printing machine.

In accordance with one aspect of the present invention, only the two load-bearing radial spacer members 112 positioned at the two opposing ends 113, 114 of an adapter sleeve

101, 201 or 301 of the present invention are connected permanently to the extreme opposite ends of the internal layer 104 and define inner surfaces that are rigid and non-deformable and formed by material of very low coefficients of dynamic and static friction. In some presently preferred embodiments, the two load-bearing, end radial spacer members 112 are formed entirely of material that has very low dynamic and static coefficients of friction, and so the inner surfaces of the end radial spacer members 112 that define the parts of the adapter sleeve's inner bore 106 by which the two load-bearing end radial spacer members 112 engage and contact the outer support surface of the printing machine's mandrel can slide easily onto the mandrel. In other embodiments, the two load-bearing, end radial spacer members 112 are connected, either directly (FIGS. 7 and 9-11) or indirectly (FIGS. 1-3) to an insert 127 of material of very low static and dynamic friction coefficients, and it is this insert or section 127 that defines the part of the adapter sleeve's inner bore 106 by which each of the two load-bearing end radial spacer members 112 engages and contacts the outer support surface of the printing machine's mandrel.

According to one characteristic of the invention, the inner bore 106 of the adapter sleeve 101, 201, 301 is defined at each opposite end 113 and 114 of the sleeve body 102 by a segment 127 of material of very low static and dynamic friction coefficient (for example between about 0.045 and about 0.050). The material forming the insert 127 can be known material of very low friction coefficient such as polytetrafluoroethylene, nylon, or molybdenum dichloride. This insert 127 is rigid and is not radially deformable, but is of rigid annular shape that defines and also bounds the inner bore 106 of the adapter sleeve 101, 201, 301. The innermost surface 128 of this insert 127 has a diameter substantially equal to that of the mandrel on which the adapter sleeve 101 is to be mounted so as to cooperate by an interference fit with the mandrel on mounting or removing the sleeve on or from the mandrel. However, due to the very low friction coefficient of the insert 127, the innermost surface 128 of this insert 127 slides easily with respect to the outer surface of the mandrel of the printing machine when mounting the adapter sleeve 101, 202, 301 onto the mandrel. The diameter of the inner bore 106 defined at each segment 127 is slightly larger than the diameter of the inner surface 105 of the internal layer 104 disposed near that insert 127 at each end spacer member 112 present at the opposing ends 113 and 114 of the sleeve body 102. In some embodiments for example, the diameter of the inner bore 106 defined at each segment 127 is about ten microns larger than the diameter of the inner surface 105 of the internal layer 104 disposed near that insert 127 at each end spacer member 112 present at the opposing ends 113 and 114 of the sleeve body 102.

The radial thickness of this insert 127 desirably is very small, and in one embodiment is between about 0.4 and about 0.7 mm. However, together with the presence of the rigid end radial spacer members 112, the insert 127 contributes to stiffening the adapter sleeve 101, 201, 301. At the same time, as its constituent material is of low friction coefficient, even though the inner diameter of each insert 127 (and hence of the adapter sleeve bore 106 thereat) is substantially equal to the outer diameter of the mandrel (i.e. inner diameter of the insert 127 corresponds to the outer diameter of the mandrel, leaving aside tolerances) the adapter sleeve 101, 201, 301 can be slid onto the mandrel over that portion of the adapter sleeve's bore 106 formed by the inner surface 128 of the insert 127. Thus, a shown in FIGS. 1 and 11 for example, it is important that the free edge 127*a* of the insert 127 starts coincident with the free edge of the adapter sleeve's bore 106 and extends longitudinally toward the opposite end of the adapter sleeve sufficiently to enable the adapter sleeve to begin to be mounted on the mandrel until the inner surface of the internal layer 104 of the adapter sleeve 101, 201, 301 comes into contact with the outer surface of the mandrel. Typically, the longitudinal length of the insert 127 measured from the free end of the adapter sleeve's bore 106 toward the opposite end of the adapter sleeve 101, 201, 301 desirably is about 25 millimeters.

Referring to FIG. 11 for example, this partly cross sectional and partly perspective view shows a section of a blind end radial spacer member 112D alongside an intermediate radial spacer member 112H of an adapter spacer sleeve 301. Note that the diameter of the innermost surface 128 of the insert 127 is larger than the diameter of the inner surface 105 of internal first layer 104. In FIG. 11, this difference in diameters and the radial expansion gap 107 are exaggerated larger than life and the axial distance between the blind end radial spacer member 112D and the intermediate radial spacer member 112H is exaggerated smaller than life for purposes of this illustration of the state of the adapter sleeve 301 when not mounted on a mandrel. Mounting the sleeve 301 in FIG. 11 on the mandrel begins by sliding the innermost surface 128 of sleeve's the insert 127 onto the mandrel. Then the compressed air supplied to the surface of the mandrel is turned on and expands the outer surface 104*b* of the internal layer 104 into the radial expansion gap 107 as the diameter of the inner surface 105 of internal first layer 104 expands sufficiently to become slightly larger than the diameter of the innermost surface 128 of the insert 127, thereby enabling the entire adapter sleeve 301 to be slid onto the outer surface 103*b* of the mandrel 103 as depicted in FIG. 8 for example. Once the entire adapter sleeve 301 is desirably positioned on the mandrel, the compressed air is turned off and the outer surface 104*b* of the internal layer 104 contracts less than the full measure of the radial expansion gap 107 so that the diameter of the inner surface 105 of internal first layer 104 contracts only sufficiently to contact and tightly grip the outer surface 103*b* of the mandrel 103 and provide an interference fit with the outer surface 103*b* of the mandrel 103 of the printing machine. These steps are conducted in reverse to remove the adapter sleeve 301 from the mandrel 103 of the printing machine.

Similarly for the adapter sleeves 101, 201 in FIGS. 1-3, on feeding air to the outer surface of the mandrel (not shown), the internal layer 104 expands radially, and hence the adapter sleeve 101, 201 can continue its mounting until it is completely superposed on the mandrel. On terminating the compressed air feed, the internal layer 104 contracts onto the mandrel to torsionally lock the adapter sleeve 101, 201 onto the mandrel by an interference fit. Since the diameter of the inner surface of each insert 127 is substantially equal to the outer diameter of the mandrel, the adapter sleeve 101, 201 fits onto the mandrel without slack.

By presenting the inserts 127 on the opposite ends of the adapter sleeves 101, 201, 301 and an internal layer 104 which is deformable (except at the inserts 127) by the use of compressed air, the internal layer 104 can be made to expand in order to mount the adapter sleeve 101, 201, 301 onto the mandrel (by virtue of the action of the air present between the two). And yet because of the load-bearing, rigid, radial spacer members 112, the adapter sleeve 101, 201, 301 of the invention is highly rigid and resistant to those vibrations which arise during its use in a printing machine. This rigidity of the adapter sleeve 101, 201, 301 prevents the vibrations generated during the use of the adapter sleeve 101, 201, 301 in a printing machine from being able to deform the adapter sleeve 101, 201, 301 in a manner that makes the adapter sleeve 101, 201, 301 unusable or causes a reduction in print quality. Hence the adapter sleeve 101, 201, 301 of the invention, although usable in the manner of conventional adapter sleeves, is not subjected to those deformations that affect the conventional adapter sleeves, particularly if used on mandrels rotating at more than 400 r.p.m. The invention therefore offers a lightweight but highly rigid adapter sleeve 101, 201, 301.

In some embodiments of the adapter sleeve 301 of the invention in which the end radial spacer members are formed by a vacuum mold process, the annular inserts 127 desirably are incorporated by initially disposing the inserts 127 in the desired location of a mold. In the blind end radial spacer member 112D shown for example in FIGS. 9 and 10 for a piped embodiment, a hollow tube 108 and an insert 127 are so placed into the mold, and then precursor material is poured into the mold. Similarly, in the end radial spacer member 112I shown for example in FIG. 12 for a flow through embodiment, an insert 127 is placed into the mold, and then precursor material is poured into the mold.

In a presently preferred method of fabricating end radial spacer members 112A, 112B, 112C, 112D, 112E and 112I, the precursor desirably is composed of a rigid material such as carbon fiber and epoxy resin that is impregnated with a suitable low friction coefficient material such as molybdenum dichloride. This precursor material then is vacuum molded to produce a unitary structure that is further processed with appropriate holes (and possibly a groove defined by dotted lines 122*a*, 122*b* in FIG. 12) to become the various end radial spacer members 112A, 112B, 112C, 112D, 112E and 112I. All of the exposed surfaces of such end radial spacer members 112A, 112B, 112C, 112D, 112E and 112I have the desired low coefficients of dynamic and static friction. Accordingly, the resulting molded inner annular surface 212*a* of the inner flange 212 becomes imparted with the requisite low coefficients of dynamic and static friction. The appropriate holes 116A, 116B, 116C, 116D, 116E, 117 and feeder channel 116 are formed in the end radial spacer members 112A, 112B, 112C, 112D, 112E and 112I and in the intermediate radial spacer members 112F, 112G, 112H. In this way, adapter sleeves in accordance with the present invention are contemplated with radial spacer members having diameters measuring as large as forty centimeters.

In some embodiments of the adapter sleeve 101, 201 of the invention, the annular inserts 127 desirably are incorporated by initially disposing the inserts 127 on a forming mandrel (109 in FIG. 13) that can be used to produce adapter sleeves. The inserts 127 are placed in positions corresponding to those positions to be assumed by the end radial spacer members 112 within the adapter sleeve 101, 201 shown in FIGS. 1-3. For example, these inserts 127 can be incorporated within the adapter sleeve 101, 201 by depositing on a forming mandrel 109 such as shown in FIG. 13, a suitable layer of low friction coefficient material such as molybdenum dichloride and awaiting a suitable time (for example one day) for this layer to solidify. The entire assembly desirably could be placed in an oven at a suitable temperature (for example between about 70° and about 85° C.) to enable this layer of low friction coefficient material to harden in a shorter time.

Using known methods, the glass fibre lining bonded with epoxy resin (or the like) is then applied over the inserts 127 to form the internal layer 104 of the embodiments of the adapter sleeves 101, 201 shown in FIGS. 1-3. In a manner similar to what is depicted in FIG. 13, the strip 119 of glass fibre lining bonded with epoxy resin (or the like) is wound around the outer surface 109*b* of the forming mandrel 109, which outer surface 109*b* has a diameter that is slightly undersized relative to the diameter of the outer surface of the mandrel of the printing machine on which the adapter sleeve 101, 201 is to be mounted. The outer surface 109*b* of the forming mandrel 109 can be configured as a right cylinder or can be tapered in a conical shape, the latter enabling the adapter sleeve 101, 201, 301 to fit onto a tapered mandrel.

After the internal layer 104 has hardened (within known times and by known methods), the end radial spacer members 112A, 112B, 112C are placed in positions coincident with the inserts 127 and glued to the outer surface 104*b* of the internal layer 104. The external layer 110 already formed in the same manner as the internal layer 104 is applied on the outer supporting surfaces 115*b* of the spacer members 112.

If any intermediate radial spacer members 112F, 112G, 112H are desired, each must be put in place once the formation of the internal layer 104 has started from one end radial spacer member and reached the axial location where such intermediate radial spacer member is to be located. The intermediate radial spacer member desirably is held in place by a paper tape disposed between the inner diameter of the intermediate radial spacer member and the outer diameter of the internal layer 104, as this tape disintegrates during later heat processing of the sleeve and leaves the desired radial expansion gap 107. Only the end radial spacer members 112A, 112B, 112C are fixed by gluing to the internal layer 104. Any necessary compressed air tubes 121, 131 and associated connectors 132 are assembled and put into place. The external layer 110 is then fixed by gluing to the upper support surfaces 115*b* of the end radial spacer members 112A, 112B, 112C and any desired intermediate radial spacer members 112F, 112G, 112H. The outer surface 111 of the external layer 110 is then ground in the usual manner and after the relevant time known to the person of ordinary skill in the art. The radial thickness from the outer surface 111 of the external layer 110 to the inner surface 128 of the insert 127 desirably is at least about fifteen millimeters. However, adapter sleeves in accordance with the present invention with such radial thicknesses measuring fifteen centimeters are contemplated. By virtue of the (briefly) described above production method, each insert 127 becomes inseparably rigid with the internal layer 104 and the end radial spacer members 112A, 112B, 112C and forms a single integrated piece therewith.

The radial spacer members 112 of the piped adapter sleeve embodiment 101 shown in FIG. 2 for example differ somewhat in their configurations from the radial spacer members 112 of the flow through adapter sleeve embodiment 201 shown in FIG. 3 for example primarily due to the differences required by the different ways that pressurized air is provided to the outer surface 111 of the external layer 110 to enable printing sleeves to be air-mounted onto the spacer sleeves 101, 201. This statement also applies to the end radial spacer members 112D, 112E of the piped adapter sleeve embodiment 301 shown in FIG. 8 and the end radial spacer member 112I shown in FIG. 12 for example for a flow through adapter sleeve embodiment. Also, the end radial spacer members 112A, 112B, 112C, 112D, 112E, 112I at the extreme ends 113, 114 of the adapter sleeves 101, 201, 301 differ from the intermediate radial spacer members 112F, 112G, 112H primarily due to the differences required by the way that pressurized air is provided to the outer surface 111 of the external layer 110 to enable printing sleeves to be air-mounted onto the adapter sleeves 101, 201, 301.

In the embodiment shown in FIG. 2 for example, the blind end radial spacer member 112A is located at the end of the sleeve 101 where air is to be directed onto the outer surface 111 of the adapter sleeve 101 to enable a printing cylinder to be mounted on or removed from the adapter sleeve 101. The blind end radial spacer member 112A desirably internally defines a plurality of radial spacer member holes 116A with each hole 116A extending radially into the blind end radial spacer member 112A from the outer surface thereof. As shown in FIG. 2 for example, an outwardly facing end of each radial spacer member hole 116A communicates directly with and is aligned with an inwardly facing end of an external radial hole 118 that desirably is provided radially through the external layer 110 of the adapter sleeve. As shown in FIG. 2 for example, the opposite and outwardly facing end of each external radial hole 118 opens onto the outer surface 111 of the external layer 110 for the distribution of pressurized air to the outer surface 111 of the external layer 110. As shown in FIG. 1 for example, a plurality of the external radial holes 118 can be located symmetrically spaced apart around the circumference of the adapter sleeve 101 at one end 113 thereof. Depending on the outside diameter of the adapter sleeve 101, about six, eight or ten external radial holes 118 can be evenly spaced around the circumference of the spacer member 112 at one end 113 of the adapter sleeve 101.

As shown in FIG. 2 for example, the blind end radial spacer member 112A desirably internally defines a feeder channel 116 that is hollow and that extends circumferentially around the entire blind end radial spacer member 112A. The inwardly facing end of each of the plurality of radial spacer member holes 116A connects to the feeder channel 116 so that pressurized air filling the feeder channel 116 will be supplied to each external radial hole 118 via an aligned radial spacer member hole 116A. As further shown in FIG. 2, a longitudinal hole 116B is defined axially into the blind end radial spacer member 112A and connects into the feeder channel 116.

As shown in FIGS. 1 and 2, a longitudinal through hole 116E is defined axially (parallel to the axis W of the body 102) through the open end radial spacer member 112B at the other end 114 of the adapter sleeve 101. Desirably, as shown in FIG. 1, an internally threaded section of this longitudinal through hole 116E through the open end radial spacer member 112B opens into the outwardly facing end (or lateral face) of the adapter sleeve 101. A detachable pressure connector (conventional and not shown) can be threaded into the longitudinal through hole 116E and provided with a source of compressed air.

In a first piped embodiment shown in FIGS. 1 and 2 for example, the air that each external radial hole 118 receives from outside the adapter sleeve 101 desirably is routed axially via a single conduit formed by one or more tubes 121, 131 connected between the two opposite end radial spacer members 112A, 112B through the empty space 130 between the internal layer 104 and the external layer 110. In adapter sleeves of relatively smaller length on the order of one to two meters for example, one end of a single tube desirably connects via a quick plug-in connector 132*a* (FIG. 2) into the inwardly facing end of the longitudinal through hole 116E in the open end radial spacer member 112B while the opposite end of the single tube connects via another quick plug-in connector 132*b* (FIG. 2) into the inwardly facing end of the longitudinal hole 116B of the blind end radial spacer member 112A.

The embodiment shown in FIG. 2 is intended to illustrate the types of modifications that can be made to accommodate piped adapter sleeves that have relatively longer lengths and have relatively larger diameters. Accordingly, as shown in FIG. 2, one end of a tube 131 forming part of a single air conduit desirably connects via a quick plug-in connector 132*a* into the inwardly facing end of the longitudinal through hole 116E in the open end radial spacer member 112B while one end of another tube 121 forming part of a single air conduit connects via another quick plug-in connector 132*b* into the inwardly facing end of the longitudinal hole 116B of the blind end radial spacer member 112A. Compressed air can be fed through the longitudinal through hole 116E into the single air conduit formed by connected tubes 121, 131 and thence carried to and into the longitudinal hole 116B, around the feeder channel 116 and out of the external radial holes 118 via the aligned radial spacer member holes 116A such that compressed air reaches the surface 111 of the external layer 110, and the compressed air reaching the surface 111 enables the printing cylinder to be mounted onto the outer surface 111 of the piped adapter sleeve 101.

In the first piped adapter sleeve embodiment shown in FIGS. 1 and 2, each of a first set of external radial holes 118 is positioned in proximity to the end 113 of the adapter sleeve 101 to which the printing sleeve will be addressed when being mounted thereon. Each of this first set of external radial holes 118 cooperates with a correspondingly aligned radial spacer member hole 116A, which is in turn connected via the circumferential passage 116 to communicate with a longitudinal hole 116B (i.e. disposed parallel to the axis W of the body 102) defined axially within the same blind end radial spacer member 112A through the inwardly facing lateral face thereof. As shown in FIG. 2, this longitudinal hole 116B in the end radial spacer member 112 nearest the end 113 of the adapter sleeve 101 is connected to a conduit such as a tube 121 that extends axially within the space 130 between the layers 104 and 110. As shown in FIG. 2, the section of the air conduit formed by the tube 121 connects the longitudinal hole 116B to communicate via a quick plug-in connector 132*c* with a corresponding longitudinal hole 116C defined axially into a triple-connection, intermediate radial spacer member 112F positioned within this space 130 and shown in more detail in FIG. 4.

As shown in FIG. 2, this latter longitudinal hole 116C is connected via a quick plug-in connector 132*d* to communicate with a further tube 131 forming the air conduit passing axially through a longitudinal hole 116D of a double-connection, intermediate radial spacer member 112G positioned within the space 130 and shown in more detail in FIG. 5. Note that this different intermediate radial spacer member 112G through which the longitudinal hole 116D is defined need not be provided with a circumferential passage 116 or any radial spacer member holes 116A because there is no need for any external radial holes 118 at this axial location of the adapter sleeve 101. However, the further tube 131 passing through the longitudinal hole 116D is connected to communicate with a longitudinal hole 116E of the open end radial spacer member 112B positioned at the other end 114 of the adapter sleeve 101. This longitudinal hole 116E through the radial spacer member 112B at the other end 114 of the adapter sleeve 101 opens into that end (or lateral face) of the adapter sleeve 101 to hence enable compressed air to be fed through the longitudinal hole 116E such that when the compressed air reaches the surface 111 of the external layer 110, the compressed air enables the printing cylinder to be mounted onto the adapter sleeve 101.

An adapter sleeve 101 having a larger length and/or diameter may include a greater number of radial spacer members 112 within the space 130 with a circumferential passage 116 and radial spacer member holes 116A than are shown in the aforedescribed embodiment depicted in FIGS. 1 and 2. In any event, the longitudinal spacer member hole 116B of the closed end radial spacer member 112A located at the first end 113 of the body 102 desirably can be connected in communication with a tube 121 extending parallel to the axis W of the body 102, to the closest spacer member 112 and so on, until arriving at that open end radial spacer member 112B positioned at the second end 114 of the body 102 from which compressed air is fed through longitudinal hole 116E.

A piped embodiment of an adapter sleeve having a larger length and/or diameter desirably may include a number of external radial holes at more than one axial distance from the end 113 of the adapter sleeve 101, 201, 301 where the majority of the external radial holes 118 are located. In this way, compressed air can be supplied to the outer surface 111 of the external layer 110 of the adapter sleeve at a location that is axially disposed closer to the center of the adapter sleeve. FIGS. 1, 2 and 4 are referenced to illustrate such an example of a piped adapter sleeve 101. FIGS. 7 and 8 also are referenced to illustrate another presently preferred embodiment of such a piped adapter sleeve 301 having a relatively larger length and/or diameter.

In the view shown in FIG. 1, two external radial holes 118 are aligned axially along the line of sight connecting the arrows designated 2—2. It is the one of these two axially aligned external radial holes 118 that is disposed farther from the end 113 of the adapter sleeve 101 (where the plurality of external radial holes 118 are circumferentially aligned) that is desired when dealing with relatively longer and/or larger diameter adapter sleeves. This more axially inwardly disposed external radial hole 118 also is shown in FIGS. 2 and 4 as being aligned with a corresponding radial spacer member hole 116A defined radially into an underlying triple-connection, intermediate radial spacer member 112F. Moreover, as shown in FIGS. 2 and 4, the triple-connection, intermediate radial spacer member 112F desirably internally defines a feeder channel 116 that is hollow and that extends circumferentially around the entire intermediate radial spacer member 112F. Though not visible in the views shown in FIGS. 2 and 4, there desirably is a second more axially inwardly disposed external radial hole 118 that is circumferentially aligned (desirably 180 degrees apart) with the more axially inwardly disposed external radial hole 118 that is depicted in FIGS. 2 and 4. The second more axially inwardly disposed external radial hole 118 is also aligned with a corresponding radial spacer member hole 116A defined radially into the underlying triple-connection, intermediate radial spacer member 112F. The inwardly facing end of each of these two radial spacer member holes 116A defined in the intermediate radial spacer member 112F connects to the feeder channel 116 so that pressurized air filling the feeder channel 116 will be supplied to each of the two external radial holes 118 via an aligned radial spacer member hole 116A. In this way, compressed air can be supplied to the outer surface 111 of the external layer 110 of the adapter sleeve 101 at a location that is axially disposed closer to the center of the adapter sleeve 101.

In another piped embodiment shown in FIG. 8 for example, the air that each external radial hole 118 receives from outside the adapter sleeve 301 desirably is routed axially via conduits formed by compressed air tubes 121*a*, 121*b*, 131 connected between the two opposite end radial spacer members 112D, 112E through the empty space 130 between the internal layer 104 and the external layer 110. As shown in FIG. 7, one opposite end of compressed air tube 131 is connected to a longitudinal through hole 116E in the open end radial spacer member 112E. As shown in FIG. 8, the opposite end of compressed air tube 131 is connected via a triple connector 133 to one end of each of compressed air tubes 121*a*, 121*b*. As shown in FIG. 10, the blind end radial spacer member 112D desirably internally defines a feeder channel 116 that is hollow and that extends circumferentially around the entire blind end radial spacer member 112A. When the blind end radial spacer member 112D is vacuum molded, it is desirable to insert a hollow tube 108 that becomes molded into the blind end radial spacer member 112D and forms the hollow feeder channel 116. As shown in FIG. 11, the inwardly facing end of each of the plurality of radial spacer member holes 116A connects to the feeder channel 116 so that pressurized air filling the feeder channel 116 will be supplied to each external radial hole 118 via an aligned radial spacer member hole 116A. As shown in FIGS. 9 and 10, the opposite ends of compressed air tubes 121*a*, 121*b* are connected into the feeder channel 116 that is defined in the blind end radial spacer member 112D.

In the view shown in FIG. 7, two external radial holes 118 are aligned axially with each other. It is the one of these two axially aligned external radial holes 118 that is disposed farther from the end 113 of the adapter sleeve 301 (where the plurality of external radial holes 118 are circumferentially aligned) that is desired when dealing with relatively longer and/or larger diameter adapter sleeves. As shown in FIGS. 7 and 8 for example, this more axially inwardly disposed external radial hole 118 is aligned with and connected in communication with the free end 124 of a return pressure tube 123*b*. As shown in FIG. 9 for example, the opposite end of the return pressure tube 123*b* is connected to the feeder channel 116 that runs circumferentially around the blind end radial spacer member 112D. As shown in FIG. 9, there desirably is a similar return pressure tube 123*a*, which has one end connected to a second more axially inwardly disposed external radial hole 118 (not visible in the views shown in FIGS. 7 and 8) that is circumferentially aligned (desirably 180 degrees apart) with the more axially inwardly disposed external radial hole 118 that is depicted in FIG. 7. As shown in FIG. 9, the other end of the return pressure tube 123*a* also is connected to the feeder channel 116 that runs circumferentially around the blind end radial spacer member 112D.

When the piped adapter sleeve 301 has been mounted on a mandrel 103 of a printing machine as shown in FIG. 8, a source of compressed air is connected longitudinal through hole 116E shown in FIG. 7 defined axially through the open end radial spacer member 112E at the one end 114 of the adapter sleeve 301. As shown in FIG. 8, the compressed air is piped through the compressed air tube 131 and into the two compressed air tubes 121*a* and 121*b* via the triple connector 133. Referring to FIGS. 7 and 9-11, the compressed air travels into the feeder channel 116 in the blind end radial spacer member 112D. Some of the compressed air entering the feeder channel 116 makes its way to the outer surface 111 of the external layer 110 via each of the radial spacer member holes 116A in the blind end radial spacer member 112D and the aligned external radial holes 118 in the external layer 110. While the rest of the compressed air entering the feeder channel 116 makes its way to the outer surface 111 of the external layer 110 via each of the return pressure tubes 123*a*, 123*b* that are connected to the external radial holes 118 that are defined through the external layer 110 at locations that are disposed axially inwardly away from the one end 113 of the adapter sleeve 301.

In a flow through embodiment of an adapter sleeve 201 shown in FIG. 3, the air that each external radial hole 118 receives from outside the adapter sleeve 201 is routed to each external radial hole 118 via the air that reaches the inner surface 105 of the internal layer 104 and/or one or more corresponding holes (or groove) that open through the outer surface of the conventional mandrel (not shown) of the printing machine. Though the embodiment of an adapter sleeve 201 shown in FIG. 3 has external radial holes 118 on each opposite end of the sleeve 201, a more typical case would be for the external radial holes 118 to be on only one end of the adapter sleeve and for the mandrel also to have a set of air holes on only one end of the mandrel.

In the flow through embodiment shown in FIG. 3, each of the load-bearing end radial spacer members 112C desirably is provided with at least one radial spacer member through hole 117 therethrough. As shown in the FIG. 3 embodiment of the adapter sleeve 201, each external radial hole 118 defined through the external layer 110 and aligned with the corresponding radial spacer member through hole 117 are connected in communication with a corresponding coaxial internal radial hole 122 provided through the internal layer 104 and the insert 127. The compressed air can reach the outer surface 111 of the external layer 110 as the compressed air entering the internal radial hole 122 from the inner surface 105 of the internal layer 104 (or rather originating from a usual corresponding hole provided in the mandrel through which air exits to create an air cushion for mounting the adapter sleeve 101 on the mandrel).

In the flow through embodiment of an end radial spacer member 112I shown in FIG. 12, each of the load-bearing, end radial spacer members 112I desirably is provided with a plurality of radial spacer member through holes 117 defined radially through the web 214 of the end radial spacer member 112I. In a flow through adapter sleeve embodiment that includes an end radial spacer member 112I such as shown in FIG. 12, the air that each external radial hole 118 receives from outside the adapter sleeve is routed to each external radial hole 118 via the air that reaches the inner surface 128 of the insert 127 that lines the inner annular surface 212*a* of the inner flange 212. This compressed air originates from one or more corresponding holes (or a groove, as the case may be) that open through the outer surface of the conventional mandrel (not shown) of the printing machine. As shown in FIG. 12, the internal radial holes 122 through the insert 127 allows passage of compressed air that reaches the inner surface 128 of the insert 127 to be conducted through each corresponding aligned radial spacer member through hole 117. Each radial spacer member through hole 117 is aligned with a corresponding external radial hole 118 defined through the external layer 110 so that the compressed air can reach the outer surface 111 of the external layer 110. Alternatively, or in addition to the internal radial holes 122, a groove can be defined as shown schematically in FIG. 12 by the parallel dotted lines 122*a*, 122*b*, and compressed air from the mandrel can fill this groove defined in the inner surface 128 of the insert 127 and be transported to the outer surface 111 of the external layer 110 to permit air mounting of a printing cylinder.

An alternative embodiment of an adapter sleeve suitable for a mandrel that is unconventional can be explained by reference to FIG. 11 as follows. In such an alternative embodiment, one end of the adapter sleeve is provided with an open end radial spacer member 112E (not shown in FIG. 11) that is opposite the blind end radial spacer member 112D that is depicted in FIG. 11. In the open end radial spacer member 112E of this alternative embodiment, the diameter of the inner surface 128 of the insert 127 is larger than the diameter of the inner surface 128 of the insert 127 of the blind end radial spacer member 112D depicted in FIG. 11. The unconventional mandrel likewise has one end that is has a larger diameter than the rest of the mandrel and thus forms a stepped portion resembling a larger diameter cylinder of short axial length on the end of a smaller diameter cylinder of much larger axial length. The air pressure holes or groove in the mandrel would be located at the end of the mandrel with the relatively smaller diameter. Thus, the open end radial spacer member 112E of this alternative embodiment would pass without any friction over the smaller diameter end of the mandrel and over the remaining smaller diameter portion of the majority of the mandrel. Then the open end radial spacer member 112E of this alternative embodiment would only need to be slid onto the relatively shorter axial length of the corresponding larger diameter end of the mandrel. In this way it would be easier to mount adapter sleeves on such unconventional mandrels.

Various embodiments of the invention have been described and indicated. Others are however possible in the light of the aforegoing description, and are to be considered as falling within the scope of the ensuing claims.

What is claimed is:

1. An adapter sleeve to be mounted onto the exterior surface of an intended rotary mandrel of a printing machine in order to support a printing cylinder carrying data and/or images to be printed, the adapter sleeve comprising:

a layered cylindrical body defining a longitudinal axis and having opposed ends and having an internal layer defining a longitudinal bore that is diametrically expandable by a compressed air cushion enabling the internal layer of the sleeve to be mounted on the intended mandrel;

the layered body further defining an external layer surrounding the internal layer and configured with an outer surface for supporting the printing cylinder;

at least two rigid, load-bearing, radial spacer members disposed between said layers, one of said radial spacer members being disposed at each of the opposed ends of said layered body, each said radial spacer member being configured to provide rigidity and indeformability during the use of the sleeve with time;

at least one of said radial spacer members defining at least one hole wherein said at least one hole is configured to enable compressed air to be fed onto the outer surface of said layer to enable a printing cylinder to be mounted thereon, and at least one intermediate rigid radial spacer member disposed between said radial spacer members at each of the opposed ends of said layered body, each of said at least one intermediate radial spacer members being attached to said external layer and configured to provide rigidity and indeformability during the use of the sleeve with time, each of said at least one intermediate radial spacer members being detached from said inner layer by a radial expansion gap therebetween;

wherein the layered body defines at each opposed end thereof an inner surface distinct from the longitudinal bore of the internal layer and having a diameter equal to the diameter of the exterior surface of the intended rotary mandrel, and the space that is defined radially between the external layer and the internal layer and axially between the two radial spacer members of the layered body is substantially empty except for the at least one intermediate rigid radial spacer member or members.

2. An adapter sleeve as claimed in claim 1, wherein said inner surface defined at each opposed end of the layered body having a diameter equal to the diameter of the exterior surface of the intended rotary mandrel is composed of material having static and dynamic friction coefficients between about 0.045 and about 0.050.

3. An adapter sleeve as claimed in claim 2, wherein at least one of said inner surfaces defined at each opposed end of the layered body having a diameter equal to the diameter of the exterior surface of the intended rotary mandrel is formed by an insert of material having a static and dynamic friction coefficient between about 0.045 and about 0.050.

4. An adapter sleeve as claimed in claim 3, wherein said insert being rigid and non-deformable.

5. An adapter sleeve as claimed in claim 3, wherein the material of the at least one insert is selected from the group of: polytetrafluoroethylene, nylon or molybdenum dichloride.

6. An adapter sleeve as claimed in claim 3, wherein said insert forms a single piece with the internal layer of the layered body.

7. An adapter sleeve as claimed in claim 1, wherein each of the radial spacer members is of rigid material with hardness between about 80 and about 95Shore D.

8. An adapter sleeve as claimed in claim 7, wherein the material of at least one of said radial spacer members being carbon fibre bonded with epoxy resin or aluminum or rigid polyurethane.

9. An adapter sleeve as claimed in claim 1, wherein said external layer defines at least one external radial hole extending generally radially therethrough; and wherein at least one of said radial spacer members defines at least one radial spacer member hole communicating with said one external radial hole of the external layer of the layered body and configured and disposed to transfer the compressed air to the outer surface of said external layer.

10. An adapter sleeve as claimed in claim 9, wherein at least one said radial spacer member further defines a longitudinal hole defined in said radial spacer member and communicating with said radial spacer member hole in the radial spacer member and wherein a conduit comprising at least one tube is disposed in the empty space between the internal layer and the external layer of said layered body and communicating with the longitudinal hole in the at least one spacer member.

11. An adapter sleeve as claimed in claim 9, wherein at least one internal radial hole is defined radially through the internal layer of the layered body, at least one said external radial spacer member hole of at least one of the radial spacer members is communicating with the at least one internal radial hole, and said internal radial hole of said internal layer opens into the longitudinal bore of the layered body.

12. An adapter sleeve as claimed in claim 1, wherein only each of the radial spacer members at each respective end of the layered body defines a segment of an inner surface having a diameter equal to the diameter of the exterior surface of the intended rotary mandrel and wherein that segment has an axial length that is no more than the axial length of the spacer member at the corresponding end of said layered body.

13. An adapter sleeve to be mounted onto the exterior surface of an intended rotary mandrel of a printing machine in order to support a printing cylinder carrying data and/or images to be printed, the adapter sleeve comprising:

at least two rigid load-bearing, radial spacer members, each said end radial spacer member defining an inner flange, an outer support surface and a radially extending web rigidly connecting said inner flange to said outer support surface, each said inner flange extending axially and defining an inner annular surface and an outer annular surface, at least one of said end radial spacer members being spaced axially apart from a second one of said end radial spacer members such that the inner flange of said first end radial spacer member extends axially toward said second end radial spacer member and the inner flange of said second end radial spacer member extends axially toward said first end radial spacer member;

wherein each of said inner annular surfaces of each of said inner flanges of each of said first and second radial end spacer members defines a first bore and wherein only each said first bore of said inner annular surfaces of the inner flanges is provided with low static and dynamic friction coefficients to enable the inner annular surfaces of each of said inner flanges of each of said first and second end radial spacer members to slide axially on the exterior surface of the mandrel without expanding said first bore;

an inner layer extending axially between said first end radial spacer member and said second end radial spacer member, said inner layer having a first end connected to said inner flange of said first end radial spacer member, said inner layer having a second end disposed axially opposite said first end and connecting to said inner flange of said second end radial spacer member, said inner layer defining an inner bore that is diametrically expandable by a compressed air cushion to enable the inner layer of the sleeve to be mounted on the mandrel;

an external layer extending axially between said first end radial spacer member and said second end radial spacer member, said external layer having a first end connected to said outer support surface of said first end radial spacer member, said external layer having a second end disposed axially opposite said first end and connected to said outer support surface of said second end radial spacer member, said external layer being configured and composed with a rigid outer surface for supporting the printing cylinder, said external layer being radially spaced apart from said inner layer; and at least one intermediate rigid, load-bearing, radial spacer member disposed between said end radial spacer members, each of said at least one intermediate radial spacer member being attached to said external layer and configured to provide rigidity and indeformability during the use of the sleeve with time, each of said at least one intermediate radial spacer members being detached from said inner layer by a radial expansion gap therebetween;

wherein the space that is defined radially between the external layer and the internal layer and axially between the two radial spacer members of the layered body is substantially empty except for the at least one intermediate rigid radial spacer member or members.

14. An adapter sleeve as in claim 13, wherein said first bore being formed by low friction material having static and dynamic friction coefficients between about 0.045 and about 0.050.

15. An adapter sleeve as in claim 13, wherein said first bore being formed by at least one insert forming a segment of the inner surface of the inner flange of each said end radial spacer member.

16. An adapter sleeve as claimed in claim 15, wherein said insert being composed of one or more low friction materials selected from the group of: polytetrafluoroethylene, nylon and molybdenum dichloride.

17. An adapter sleeve as in claim 13, wherein:

said first bore of each of said inner annular surfaces of each of said inner flanges of each of said first and second end radial spacer members has a diameter equal to the diameter of the exterior surface of the mandrel.

18. An adapter sleeve as in claim 17, wherein in the absence of a compressed air cushion said inner bore of said inner layer has a diameter less than the diameter of the exterior surface of the intended mandrel.

19. An adapter sleeve as claimed in claim 13, wherein said intermediate annular spacer member is composed of rigid material with hardness between about 80 and about 95 Shore D.

20. An adapter sleeve as claimed in claim 13, wherein each of the end radial spacer members is composed of rigid material with hardness between about 80 and about 95 Shore D.

21. An adapter sleeve as claimed in claim 20, wherein the material of at least one of said end radial spacer members being carbon fibre bonded with epoxy resin.

22. An adapter sleeve as claimed in claim 13, wherein said external layer defines at least one external radial hole extending generally radially therethrough; and wherein at least one of said end radial spacer members defines at least one radial spacer member hole communicating with said one external radial hole of the external layer of the layered body and configured and disposed to transfer the compressed air to the outer surface of said external layer.

23. An adapter sleeve as claimed in claim 22, wherein at least one internal radial hole is defined radially through the internal layer of the layered body, at least one said external radial spacer member hole of at least one of the flanges is communicating with the at least one internal radial hole, and said internal radial hole of said internal layer opens into the longitudinal bore of the layered body.

* * * * *